US010219580B2

(12) United States Patent
Taylor

(10) Patent No.: US 10,219,580 B2
(45) Date of Patent: Mar. 5, 2019

(54) LACE ENGAGING STRUCTURES AND OTHER FEATURES FOR ARTICLES OF FOOTWEAR AND OTHER FOOT-RECEIVING DEVICES

(71) Applicant: NIKE, Inc., Beaverton, OR (US)

(72) Inventor: Justin R. Taylor, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 914 days.

(21) Appl. No.: 14/608,547

(22) Filed: Jan. 29, 2015

(65) Prior Publication Data

US 2016/0219983 A1 Aug. 4, 2016

(51) Int. Cl.

| | |
|---|---|
| ***A43C 11/00*** | (2006.01) |
| ***A43B 3/00*** | (2006.01) |
| ***A43B 13/22*** | (2006.01) |
| ***A43C 1/00*** | (2006.01) |
| ***A43C 11/14*** | (2006.01) |
| ***A43C 11/22*** | (2006.01) |

(52) U.S. Cl.

CPC ..... *A43B 3/0078* (2013.01); *A43B 13/223* (2013.01); *A43C 1/00* (2013.01); *A43C 11/14* (2013.01); *A43C 11/22* (2013.01)

(58) Field of Classification Search

CPC .. A43C 1/00; A43C 1/003; A43C 1/06; A43C 9/00; A43C 9/06; A43C 11/14; A43C 11/20; A43C 11/22

USPC ..... 36/83, 50.1, 53

See application file for complete search history.

(56) References Cited

U.S. PATENT DOCUMENTS 588,083 A * 8/1897 Pohn ..... A43C 11/18 24/267
668,408 A * 2/1901 Kalina ..... A41B 3/08 24/379.1
759,072 A * 5/1904 Brooks ..... A41F 1/04 24/713.6

(Continued)

FOREIGN PATENT DOCUMENTS

EP 0734662 A1 10/1996
EP 2277402 A2 1/2011

(Continued)

OTHER PUBLICATIONS

Jul. 29, 2016—(WO) International Search Report—App PCT/US2016/015291.

*Primary Examiner* — Katharine Gracz
(74) *Attorney, Agent, or Firm* — Banner & Witcoff, Ltd.

(57) ABSTRACT

Uppers for articles of footwear (or foot-covering members for other foot-receiving devices) include: (a) an upper member including medial and lateral side portions, each side portion including at least one pair of slots spaced in a top-to-bottom direction and (b) a first strap portion that extends between and through each of the medial slots and the lateral slots such that the first strap portion is exposed between the pair of medial slots and between the pair of lateral slots and such that the first strap portion extends across the instep opening. One, two, or more other "strap portions" may be provided, e.g., that extend between additional pairs of medial and lateral slots and across the instep opening. A shoe lace may be provided to extend through and between areas defined by the strap portions and the pairs of medial and lateral slots.

19 Claims, 9 Drawing Sheets

(56) References Cited

U.S. PATENT DOCUMENTS 780,020 A * 1/1905 Brent ..... A43C 1/00 24/372
1,191,781 A 7/1916 Hardebeck
1,353,614 A * 9/1920 Ross ..... A43C 11/22 36/50.1
1,694,101 A * 12/1928 McClure ..... A43C 11/22 24/371
1,743,689 A * 1/1930 Scroggins ..... A43B 5/1691 36/89
2,369,254 A * 2/1945 Roman ..... A43C 1/04 36/50.1
2,591,211 A * 4/1952 Spencer ..... A43B 3/26 36/170
4,053,995 A * 10/1977 Shein ..... A43B 7/14 36/30 R
4,079,527 A 3/1978 Antonious
D247,998 S 5/1978 Lobosco
4,394,803 A * 7/1983 Goldstein ..... A43C 7/02 36/50.1
4,399,621 A 8/1983 Dassler
4,442,613 A * 4/1984 Dobbin ..... A43B 23/26 36/50.1
4,536,975 A 8/1985 Harrell
5,088,166 A * 2/1992 Lavinio ..... A43C 1/00 24/712
D333,555 S 3/1993 Hatfield et al.
5,269,078 A 12/1993 Cochrane
5,381,610 A 1/1995 Hanson
5,384,973 A 1/1995 Lyden
D368,577 S 4/1996 Mitsui et al.
D395,343 S 6/1998 Lozano
D398,144 S 9/1998 Egelja
5,862,614 A 1/1999 Koh
D421,176 S * 2/2000 Matis ..... D2/902
6,076,283 A 6/2000 Boie
6,128,835 A * 10/2000 Ritter ..... A43C 1/00 36/114
6,453,579 B1 * 9/2002 Luprete ..... A43B 7/20 36/50.1
D487,840 S 3/2004 Hillyer
6,772,541 B1 8/2004 Ritter et al.
6,990,755 B2 1/2006 Hatfield et al.
7,225,563 B2 6/2007 Chen et al.
7,343,701 B2 * 3/2008 Pare ..... A43C 1/06 36/50.1
8,291,619 B2 10/2012 Abadjian
8,321,984 B2 12/2012 Dojan et al.
8,322,049 B2 12/2012 Dojan
8,429,835 B2 4/2013 Dojan et al.
8,448,354 B2 * 5/2013 Talley ..... A43C 1/02 36/50.1
D690,917 S 10/2013 Spring
D693,109 S * 11/2013 Taylor ..... D2/972
8,578,632 B2 11/2013 Bell et al.
8,590,121 B1 * 11/2013 Patt, Jr. ..... A43B 3/0078 24/713.1
8,713,820 B2 5/2014 Kerns et al.
8,973,410 B1 * 3/2015 Podhajny ..... A43B 23/024 66/177
D738,094 S * 9/2015 Taylor ..... D2/972
D743,153 S * 11/2015 Taylor ..... D2/947
D790,208 S * 6/2017 Taylor ..... D2/973
9,687,047 B1 * 6/2017 Talley ..... A43C 9/00
D809,276 S * 2/2018 Taylor ..... D2/972
2003/0221334 A1 * 12/2003 McFee ..... A43C 11/16 36/50.1
2004/0181972 A1 9/2004 Csorba
2008/0078103 A1 * 4/2008 Liles ..... A43B 3/0078 36/50.1
2008/0110048 A1 5/2008 Dua et al.
2009/0071041 A1 3/2009 Hooper
2009/0293310 A1 * 12/2009 Bruce ..... A43B 3/0078 36/91
2010/0071230 A1 * 3/2010 Hassid ..... A43C 11/008 36/54
2010/0299966 A1 * 12/2010 Tanev ..... A43B 3/0078 36/132
2012/0110870 A1 * 5/2012 Haouari ..... A43B 3/24 36/83
2012/0117819 A1 * 5/2012 Atamian ..... A43C 1/02 36/50.1
2012/0151798 A1 * 6/2012 Friton ..... A43C 1/00 36/83
2012/0174437 A1 * 7/2012 Heard ..... A43C 1/04 36/50.1
2012/0186107 A1 * 7/2012 Crary ..... A43B 3/0078 36/103
2013/0019500 A1 * 1/2013 Greene ..... A43B 23/025 36/50.1
2013/0019501 A1 * 1/2013 Gerber ..... A43C 1/04 36/50.1
2013/0047466 A1 * 2/2013 Smith ..... A43C 5/00 36/83
2013/0086816 A1 * 4/2013 Johnson ..... A43C 1/00 36/83
2013/0097887 A1 * 4/2013 Robinson ..... A43B 23/0245 36/54
2013/0104422 A1 * 5/2013 Hatfield ..... A43B 5/001 36/103
2013/0232734 A1 * 9/2013 Schein ..... A43B 3/0078 24/302
2014/0130372 A1 * 5/2014 Aveni ..... A43B 3/122 36/83
2014/0150298 A1 6/2014 Crowley et al.
2014/0157629 A1 * 6/2014 Dojan ..... A43B 23/0275 36/83
2014/0173939 A1 * 6/2014 Carboy ..... A43B 1/0072 36/102
2014/0223771 A1 * 8/2014 Berend ..... A43B 23/0235 36/83
2014/0230277 A1 * 8/2014 Dua ..... A43B 1/04 36/84
2014/0360050 A1 12/2014 Kohatsu et al.
2015/0059208 A1 * 3/2015 Kerns ..... A43B 3/0052 36/83
2015/0082661 A1 * 3/2015 Dojan ..... A43B 3/26 36/83
2015/0121724 A1 * 5/2015 Sung ..... A43B 23/0235 36/87
2015/0296925 A1 * 10/2015 Park ..... A43C 11/22 24/72.7
2016/0081433 A1 * 3/2016 Choi ..... A43C 11/22 36/50.1
2016/0219981 A1 * 8/2016 Taylor ..... A43C 11/14
2016/0219982 A1 * 8/2016 Waatti ..... A43C 1/04
2016/0219983 A1 * 8/2016 Taylor ..... A43B 3/0078
2016/0286900 A1 * 10/2016 Parker ..... A43C 1/00
2017/0231325 A1 * 8/2017 Romagnoli ..... A43C 1/00 36/50.1

FOREIGN PATENT DOCUMENTS

FR 2980960 A1 4/2013
JP H0965908 A 3/1997

* cited by examiner

LACE ENGAGING STRUCTURES AND OTHER FEATURES FOR ARTICLES OF FOOTWEAR AND OTHER FOOT-RECEIVING DEVICES

FIELD OF THE INVENTION

The present invention relates to the field of footwear and other foot-receiving devices. More specifically, aspects of the present invention pertain to securing systems for articles of footwear and other foot-receiving devices.

BACKGROUND

Conventional articles of athletic footwear include two primary elements, an upper and a sole structure. The upper provides a covering for the foot that securely receives and positions the foot with respect to the sole structure. In addition, the upper may have a configuration that protects the foot and provides ventilation, thereby cooling the foot and removing perspiration. The sole structure is secured to a lower surface of the upper and is generally positioned between the foot and any contact surface. In addition to attenuating ground reaction forces and absorbing energy, the sole structure may provide traction and control potentially harmful foot motion, such as over pronation. General features and configurations of uppers and sole structures are discussed in greater detail below.

The upper forms a void on the interior of the footwear for receiving the foot. The void has the general shape of the foot, and access to the void is provided at an ankle or foot-insertion opening. Accordingly, the upper extends over the instep and toe areas of the foot, along the medial and lateral sides of the foot, and around the heel area of the foot. A lacing system often is incorporated into the upper to selectively change the size of the ankle opening and to permit the wearer to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

The sole structure generally incorporates multiple layers that are conventionally referred to as an "insole," a "midsole," and an "outsole." The insole (which also may constitute a sock liner) is a thin member located within the upper and adjacent the plantar (lower) surface of the foot to enhance footwear comfort, e.g., to wick away moisture. The midsole, which is traditionally attached to the upper along the upper's entire length, forms the middle layer of the sole structure and serves a variety of purposes that include controlling foot motions and attenuating impact forces. The outsole forms the ground-contacting element of footwear and usually is fashioned from a durable, wear-resistant material that includes texturing or other features to improve traction.

The primary element of a conventional midsole is a resilient, polymer foam material, such as polyurethane or ethylvinylacetate ("EVA"), that extends throughout the length of the footwear. The properties of the polymer foam material in the midsole are primarily dependent upon factors that include the dimensional configuration of the midsole and the specific characteristics of the material selected for the polymer foam, including the density of the polymer foam material. By varying these factors throughout the midsole, the relative stiffness, the degree of ground reaction force attenuation, and the energy absorption properties may be altered to meet the specific demands of the activity for which the footwear is intended to be used.

Terminology/General Information

First, some general terminology and information is provided that will assist in understanding various portions of this specification and the invention(s) as described herein. As noted above, the present invention relates to the field of footwear and other foot-receiving devices, including securing systems for such devices. "Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Securing systems," like those in accordance with at least some aspects of this invention, may help position and/or securely hold the user's foot in place with respect to the foot-covering member(s) and/or the foot-supporting member(s). "Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, etc.), and the like. "Foot-supporting members" may include components for and/or functioning as midsoles and/or outsoles for articles of footwear (or components providing corresponding functions in non-footwear type foot-receiving devices).

FIG. 1 also provides information that may be useful for explaining and understanding the specification and/or aspects of this invention. More specifically, FIG. 1 provides a representation of a footwear/foot-receiving device component 100, which in this illustrated example constitutes a portion of a sole structure for an article of footwear. The same general definitions and terminology described below may apply to footwear and foot-receiving devices in general and/or to other footwear/foot-receiving device components or portions thereof, such as an upper, a midsole component, an outsole component, etc.

First, as illustrated in FIG. 1, the terms "forward" or "forward direction" as used herein, unless otherwise noted or clear from the context, mean toward or in a direction toward a forwardmost toe area of the footwear or foot-receiving device structure or component 100. The terms "rearward" or "rearward direction" as used herein, unless otherwise noted or clear from the context, mean toward or in a direction toward a rearmost heel area of the footwear or foot-receiving device structure or component 100. The terms "lateral" or "lateral side" as used herein, unless otherwise noted or clear from the context, mean the outside or "little toe" side of the footwear or foot-receiving device structure or component 100. The terms "medial" or "medial side" as used herein, unless otherwise noted or clear from the context, mean the inside or "big toe" side of the footwear or foot-receiving device structure or component 100.

Also, various example features and aspects of this invention are disclosed or explained herein with reference to a "longitudinal direction" and/or with respect to a "longitudinal length" of a footwear/foot-receiving device component 100 (such as a footwear sole structure). As shown in FIG. 1, the "longitudinal direction" is determined as the direction of a line extending from a rearmost heel location (RH in FIG. 1) to the forwardmost toe location (FT in FIG. 1) of the footwear component 100 in question (a sole structure or foot-supporting member in this illustrated example). The "longitudinal length" L is the length dimension measured from the rearmost heel location RH to the forwardmost toe location FT. The rearmost heel location RH and the forwardmost toe location FT may be located by determining the rear heel and forward toe tangent points with respect to front and back parallel vertical planes VP when the component 100 (e.g., sole structure or foot-supporting member in this illustrated example, optionally as part of an article of footwear or foot-receiving device) is oriented on a horizontal support surface S in an unloaded condition (e.g., with no weight applied to it other than potentially the weight of the shoe/foot-receiving device components with which it is engaged). If the forwardmost and/or rearmost locations of a specific footwear or foot-receiving device component 100 constitute a line segment (rather than a tangent point), then the forwardmost toe location and/or the rearmost heel location constitute the mid-point of the corresponding line segment. If the forwardmost and/or rearmost locations of a specific footwear or foot-receiving device component 100 constitute two or more separated points or line segments, then the forwardmost toe location and/or the rearmost heel location constitute the mid-point of a line segment connecting the furthest spaced and separated points and/or furthest spaced and separated end points of the line segments (irrespective of whether the midpoint itself lies on the component 100 structure). If the forwardmost and/or rearmost locations constitute one or more areas, then the forwardmost toe location and/or the rearmost heel location constitute the geographic center of the area or combined areas (irrespective of whether the center itself lies on the component 100 structure).

Once the longitudinal direction of a component or structure 100 has been determined with the component 100 oriented on a horizontal support surface S, planes may be oriented perpendicular to this longitudinal direction (e.g., planes running into and out of the page of FIG. 1). The locations of these perpendicular planes may be specified based on their positions along the longitudinal length L where the perpendicular plane intersects the longitudinal direction between the rearmost heel location RH and the forwardmost toe location FT. In this illustrated example of FIG. 1, the rearmost heel location RH is considered as the origin for measurements (or the "0L position") and the forwardmost toe location FT is considered the end of the longitudinal length of this component (or the "1.0L position"). Plane position may be specified based on its location along the longitudinal length L (between 0L and 1.0L), measured forward from the rearmost heel RH location in this example. FIG. 1 further shows locations of various planes perpendicular to the longitudinal direction (and oriented in the transverse direction) and located along the longitudinal length L at positions 0.25L, 0.4L, 0.5L, 0.55L, 0.6L, and 0.8L (measured in a forward direction from the rearmost heel location RH). These planes may extend into and out of the page of the paper from the view shown in FIG. 1, and similar planes may be oriented at any other desired positions along the longitudinal length L. While these planes may be parallel to the parallel vertical planes VP used to determine the rearmost heel RH and forwardmost toe FT locations, this is not a requirement. Rather, the orientations of the perpendicular planes along the longitudinal length L will depend on the orientation of the longitudinal direction, which may or may not be parallel to the horizontal surface S in the arrangement/orientation shown in FIG. 1.

The terms "strap" and "strap portions" as used herein, unless otherwise noted, mean a band of material having: (a) a substantially greater width dimension ("W") than a thickness dimension ("T") and (b) a substantially greater length dimension ("L") than width dimension. As some more specific examples, "straps" or "strap portions" in accordance with at least some examples of this invention will have one or more of: (a) a width dimension to thickness dimension ratio ("W/T") over at least 75% of its longitudinal length of at least 5, (b) an absolute width dimension W of at least 4 mm over at least 75% of its length L, (c) an absolute thickness dimension T of less than 2 mm over at least 75% of its length L, and/or (d) an absolute length dimension L of at least 2.5 times its widest width dimension over that length. A "strap" or "strap portion" may be connected to or integrally formed with another element or component that is not a "strap" or "strap portion."

As some more specific examples, "straps" or "strap portions" in accordance with at least some examples of this invention may have one or more of:

a. a W/T ratio over at least 75% of the strap's length of at least 7.5, at least 10, at least 15, or at least 20; in some examples, these W/T ratio ranges will be provided over at least 85%, at least 90%, at least 95%, or even over 100% of the strap's length;
b. a W/T ratio over at least 75% of strap's length in a range of 2 to 50, in a range of 4 to 48, or in a range of 6 to 45; in some examples, these W/T ratio ranges will be provided over at least 85%, at least 90%, at least 95%, or even over 100% of the strap's length;
c. an absolute thickness dimension of less than 2.5 mm or less than 2 mm over at least 75% of the strap's length; in some examples, these thickness dimension ranges will be provided over at least 85%, at least 90%, at least 95%, or even over 100% of the strap's length;
d. an absolute width dimension over at least 75% of the strap's length of at least 5 mm or at least 8 mm; in some examples, these width dimension ranges will be provided over at least 85%, at least 90%, at least 95%, or even over 100% of the strap's length;
e. an absolute width dimension over at least 75% of the strap's length within a range from 4 to 25 mm, and in some examples, within a range from 6 to 20 mm or within a range from 6 to 16 mm; in some examples, these absolute strap width dimension ranges will be provided over at least 85%, at least 90%, at least 95%, or even over 100% of the strap's length;
f. an absolute strap length of at least 3 times or at least 5 times the strap's widest width dimension over that length;
g. an absolute width dimension that varies over the strap's length, e.g., tapers, stepwise changes, or otherwise varies in width from wider to narrower or vice versa (e.g., having a width of 4 to 10 mm at locations extending across the instep area and a width of 6 to 25 mm at its engagement with the sole structure and/or upper); and/or h. an absolute thickness dimension that varies over its length and/or width, e.g., tapers, stepwise changes, or otherwise varies in thickness from thicker to thinner or vice versa).

For determining the W/T ratios as described above, the width and thickness dimensions are measured at a common location on the strap structure. The strap's length dimension L may be measured as the dimension from: (a) a location where one end of the strap is fixed to the upper or sole structure (e.g., where the strap emerges from a location between the upper and the sole structure) and (b) a location where the other end of the strap is fixed to the upper or sole structure (e.g., where the strap emerges from a location between the upper and the sole structure on the opposite side). The strap's thickness dimension T at a given point is measured as the direct distance (shortest distance) between a first major surface and a second major surface of the strap at that point. The strap's width dimension W at a given point is measured as the direct distance (shortest distance) from one side edge of the strap to its opposite side edge at that point. These measurements are made with the strap or strap portion held taut but not under a substantial tensile force (e.g., less than 0.1 kg tensile force).

While straps or strap portions may be stretchable or unstretchable, in the illustrated examples, the strap portions are unstretchable. The terms "not stretchable" or "unstretchable," as used herein in this context, mean that the strap or strap portion stretches less than 5% of its unloaded longitudinal length under a tensile force of 10 kg.

SUMMARY

This Summary is provided to introduce some concepts relating to this invention in a simplified form that are further described below in the Detailed Description. This Summary is not intended to identify key features or essential features of the invention.

While potentially useful for any desired types or styles of shoes or foot-receiving devices, aspects of this invention may be of particular interest for athletic shoes, including basketball shoes (e.g., high top and/or mid-rise basketball shoes). The lace securing systems according to aspects of this invention also could be incorporated and used in non-footwear/non-foot-receiving device products, such as containers.

Some aspects of this invention relate to uppers for articles of footwear (or foot-covering members for other foot-receiving devices) that include: (a) an upper member made from one or more parts and including a medial side portion that extends at least along a medial side of an instep opening of the upper member and a lateral side portion that extends at least along a lateral side of the instep opening, wherein the medial side portion includes: a first pair of medial slots spaced in a top-to-bottom direction of the medial side portion and, optionally, a second pair of medial slots spaced in the top-to-bottom direction of the medial side portion; and wherein the lateral side portion includes: a first pair of lateral slots spaced in a top-to-bottom direction of the lateral side portion and, optionally, a second pair of lateral slots spaced in the top-to-bottom direction of the lateral side portion; (b) a first strap portion that extends between and through each of the first pair of medial slots and the first pair of lateral slots such that the first strap portion is exposed at least between the first pair of medial slots and between the first pair of lateral slots and such that the first strap portion extends across the instep opening; and, optionally, (c) a second strap portion that extends between and through each of the second pair of medial slots and the second pair of lateral slots such that the second strap portion is exposed at least between the second pair of medial slots and between the second pair of lateral slots and such that the second strap portion extends across the instep opening. One, two, or more other "strap portions" may be provided, e.g., that extend between additional pairs of medial and lateral slots and across the instep opening. A shoe lace may be provided to extend through and between areas defined by the strap portions and the pairs of medial and lateral slots.

As another example, aspects of this invention relate to securing systems, e.g. for uppers for articles of footwear (or foot-covering members for other foot-receiving devices) that include:

(1) an upper member made from one or more parts and including:

(a) a medial side portion (e.g., made of one or more parts) that extends at least along a medial side of an instep opening of the upper member, (b) a lateral side portion (e.g., made of one or more parts) that extends at least along a lateral side of the instep opening, (c) a first medial strap opening defined in the medial side portion;

(d) a second medial strap opening defined in the medial side portion, wherein the first medial strap opening is located closer to the lateral side portion than is the second medial strap opening;

(e) a first lateral strap opening defined in the lateral side portion; and (f) a second lateral strap opening defined in the lateral side portion, wherein the first lateral strap opening is located closer to the medial side portion than is the second lateral strap opening; and (2) a first strap portion that extends continuously and uninterrupted from:

(a) a medial side location beneath an exterior surface of the medial side portion, (b) through the second medial strap opening, (c) through the first medial strap opening and beneath the exterior surface of the medial side portion, wherein the first strap portion is exposed at an exterior of the medial side portion between the first and second medial strap openings, and wherein a first medial side lace engaging element is defined by the first strap portion and the medial side portion between the first and second medial strap openings, (d) across the instep area, (e) beneath an exterior surface of the lateral side portion at the instep opening at the lateral side, (f) through the first lateral strap opening, and (g) through the second lateral strap opening to a lateral side location beneath the exterior surface of lateral side portion, wherein the first strap portion is exposed at an exterior of the lateral side portion between the first and second lateral strap openings, and wherein a first lateral side lace engaging element is defined by the first strap portion and the lateral side portion between the first and second lateral strap openings.

One or more additional strap portions may be provided in a similar manner (e.g., extending through and between additional medial and lateral strap openings and across the instep opening area) to thereby provide additional lateral side and medial side lace engaging openings. A shoe lace may be provided that extends continuously through the first medial side lace engaging element, across the instep opening, through the first lateral side lace engaging element, and, optionally, through other present medial and lateral side lace engaging elements.

Still additional aspects of this invention relate to uppers for articles of footwear (or foot-covering members for other foot-receiving devices) that include: (a) an upper member made from one or more parts and including a medial side portion (e.g., made from one or more parts) that extends at least along a medial side of an instep opening of the upper member and a lateral side portion (e.g., made from one or more parts) that extends at least along a lateral side of the instep opening; (b) a first strap portion that extends from a first medial side location beneath the medial side portion, across the instep opening, and to a first lateral side location beneath the lateral side portion, wherein the first strap portion extends through the medial side portion to form a first medial side lace engaging component, and wherein the first strap portion extends through the lateral side portion to form a first lateral side lace engaging component, wherein the first medial and lateral side lace engaging components are separated from one another by the instep opening and are exposed at an exterior surface of the upper member; and, optionally, (c) a second strap portion that extends from a second medial side location beneath the medial side portion, across the instep opening, and to a second lateral side location beneath the lateral side portion, wherein the second strap portion extends through the medial side portion to form a second medial side lace engaging component, and wherein the second strap portion extends through the lateral side portion to form a second lateral side lace engaging component, wherein the second medial and lateral side lace engaging components are separated from one another and are exposed at the exterior surface of the upper member.

Additional aspects of this invention relate to articles of footwear/other foot-receiving devices that include an upper/foot-covering member according to any of the aspects of the invention described above and a sole structure/foot-supporting member engaged with the upper/foot-covering member. In some examples, one or more of the various strap portions described above will extend continuously and uninterrupted from a medial side location, e.g., where the upper/foot-covering member engages the sole structure/foot-supporting member, across the instep opening, and to a lateral side location, e.g., where the upper/foot-covering member engages the sole structure/foot-supporting member. Additionally or alternatively, one or more of the noted strap portions may be fixed at a medial side location, e.g., between the sole structure/foot-supporting member and a portion of the upper/foot-covering member and/or at a lateral side location, e.g., between the sole structure/foot-supporting member and a portion of the upper/foot-covering member.

Still additional aspects of this invention relate to uppers for articles of footwear that include: (a) an upper component that extends around a rear heel area of the upper, wherein the upper component includes an outer surface; (b) a first flap member engaged with the upper component, wherein the first flap member includes an outer perimeter having a secured portion and an unsecured portion, and wherein the unsecured portion is movable (e.g., foldable) between a closed position in which a first display area is at least partially concealed and an open position in which the first display area is exposed; and, optionally, (c) at least a second flap member engaged with the upper component, wherein the second flap member includes an outer perimeter having a secured portion and an unsecured portion, and wherein the unsecured portion is movable (e.g., foldable) between a closed position in which a second display area is at least partially concealed and an open position in which the second display area is exposed. The first display area may be contiguous with the second display area. When in their closed positions, the unsecured portion of the first flap member may lie adjacent, contact, and/or overlap the unsecured portion of the second flap member, and at least some of the unsecured portions of the flap members (when two or more are present) may extend in parallel (e.g., substantially parallel free edges). These flap members may be located on opposite sides of the upper component, and, when in the closed positions, the unsecured portions may lie along a rear central heel area of the upper component (e.g., oriented substantially vertically along the rearmost heel location).

The "display areas" may be at various locations with respect to the flap member(s). For example, a display area may constitute an interior surface of the flap member that is concealed when the flap member is closed and exposed when the flap member is opened. Additionally or alternatively, a display area may be provided as an exterior surface of the upper component or other footwear component located behind the flap member(s) when closed. As another example, a heel tab may be engaged with the upper component, and a portion of the heel tab may extend beneath and be concealed when the first and/or second flap members are in the closed positions and be exposed when the first and/or second flap members are in the open positions (and thus the heel tab surface may optionally function as the first and/or second display areas).

Another aspect of this invention relates to sole structures for articles of footwear that include herringbone type contact surface portions wherein at least two of the herringbone contact surface portions are oriented in different directions. As some more specific examples, sole structures in accordance with at least some examples of this invention may include two or more of: (a) a first contact surface portion located at a medial, heel area including a first herringbone traction element structure, wherein the first herringbone traction element structure includes a first propagation direction and a first plurality of peaks, wherein the first propagation direction extends in a heel-to-toe direction, and wherein the first plurality of peaks point toward medial and lateral sides of the sole structure; (b) a second contact surface portion located at a medial, forefoot area (e.g., at least beneath the first metatarsal head area) including a second herringbone traction element structure, wherein the second herringbone traction element structure includes a second propagation direction and a second plurality of peaks, wherein the second propagation direction extends in a medial side-to-lateral side direction, and wherein the second plurality of peaks point toward heel and toe ends of the sole structure; (c) a third contact surface portion located at a lateral, heel area including a third herringbone traction element structure, wherein the third herringbone traction element structure includes a third propagation direction and a third plurality of peaks, wherein the third propagation direction extends in the medial side-to-lateral side direction, and wherein the third plurality of peaks point toward the heel and toe ends of the sole structure (if desired, the third propagation direction may be parallel to the second propagation direction); and/or (d) a fourth contact surface portion located at a lateral, forefoot area (e.g., at least beneath the fifth metatarsal head area) including a fourth herringbone traction element structure, wherein the fourth herringbone traction element structure includes a fourth propagation direction and a fourth plurality of peaks, wherein the fourth propagation direction extends in the heel-to-toe direction, and wherein the fourth plurality of peaks point toward medial and lateral sides of the sole structure (optionally, the fourth propagation direction may be parallel to the first propagation direction and/or the first contact surface portion may extend continuously to the fourth contact surface portion). As an option, the first herringbone traction element structure may extend from the medial, heel area, across an arch area of the sole structure, to a lateral, forefoot area of the sole structure (and thus form the fourth contact surface portion mentioned above).

If desired, one or more recessed grooves may be provided in the sole structure, e.g., to increase and/or control the flexibility of the sole structure and/or to separate the different contact surface portions/herringbone traction element structures from one another. As some more specific examples, a recessed groove may extend between and separate the first herringbone traction element structure and the second herringbone traction element structure in a forefoot area of the sole structure (in examples where the first herringbone traction element structure extends from the medial heel area to the lateral forefoot area). One or more recessed grooves may separate the first and third contact surface portions in the heel and/or midfoot areas of the sole structure. The first contact surface portions (or other contact surface portions) may include a recessed groove within it.

Additional aspects of this invention relate to methods of making uppers, foot-covering members, sole structures, foot-supporting members, articles of footwear, and/or other foot-receiving devices of the various types and aspects of the invention described above.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

The reader should understand that the attached drawings are not necessarily drawn to scale.

DETAILED DESCRIPTION

In the following description of various examples of footwear and foot-receiving device structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures without departing from the scope of the present invention.

I. DETAILED DESCRIPTION OF EXAMPLE ARTICLES OF FOOTWEAR OR OTHER FOOT-RECEIVING DEVICES ACCORDING TO THIS INVENTION

Referring to the figures and following discussion, various articles of footwear and features thereof in accordance with the present invention are disclosed. The footwear depicted and discussed are athletic shoes (e.g., basketball shoes), but the concepts disclosed with respect to this footwear may be applied to a wide range of athletic footwear styles, including, but not limited to: walking shoes, tennis shoes, soccer shoes, football shoes, basketball shoes, running shoes, and cross-training shoes. In addition, the concepts of the present invention may be applied to a wide range of non-athletic footwear, including work boots, sandals, loafers, and dress shoes, as well as to other foot-receiving devices. Additionally, concepts of the present invention may be applied to securing devices for other components or products, such as containers.

Figure 1:
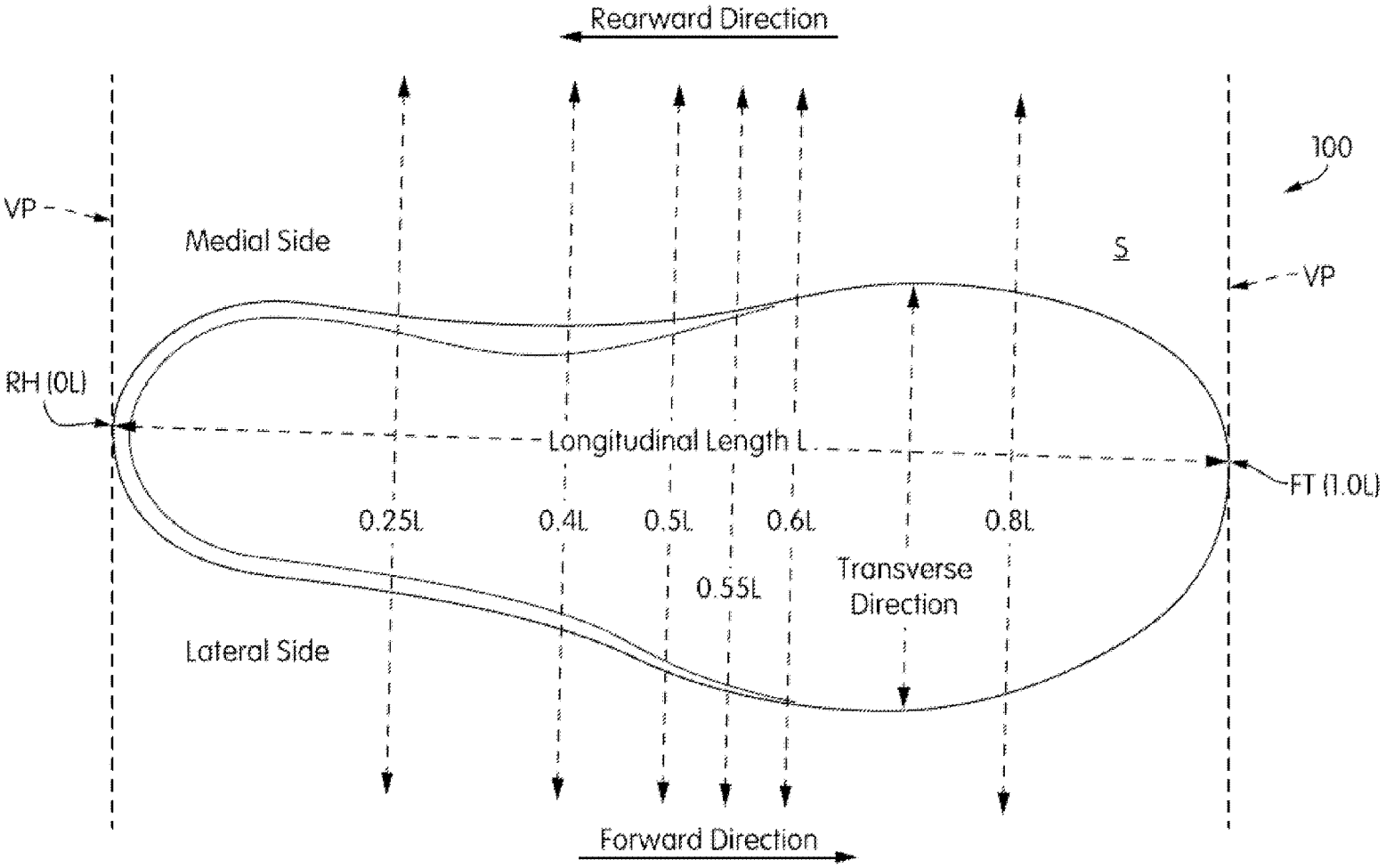
FIG. 1 is provided to help illustrate and explain background and definitional information useful for understanding certain terminology and aspects of this invention.
Figure 2A:
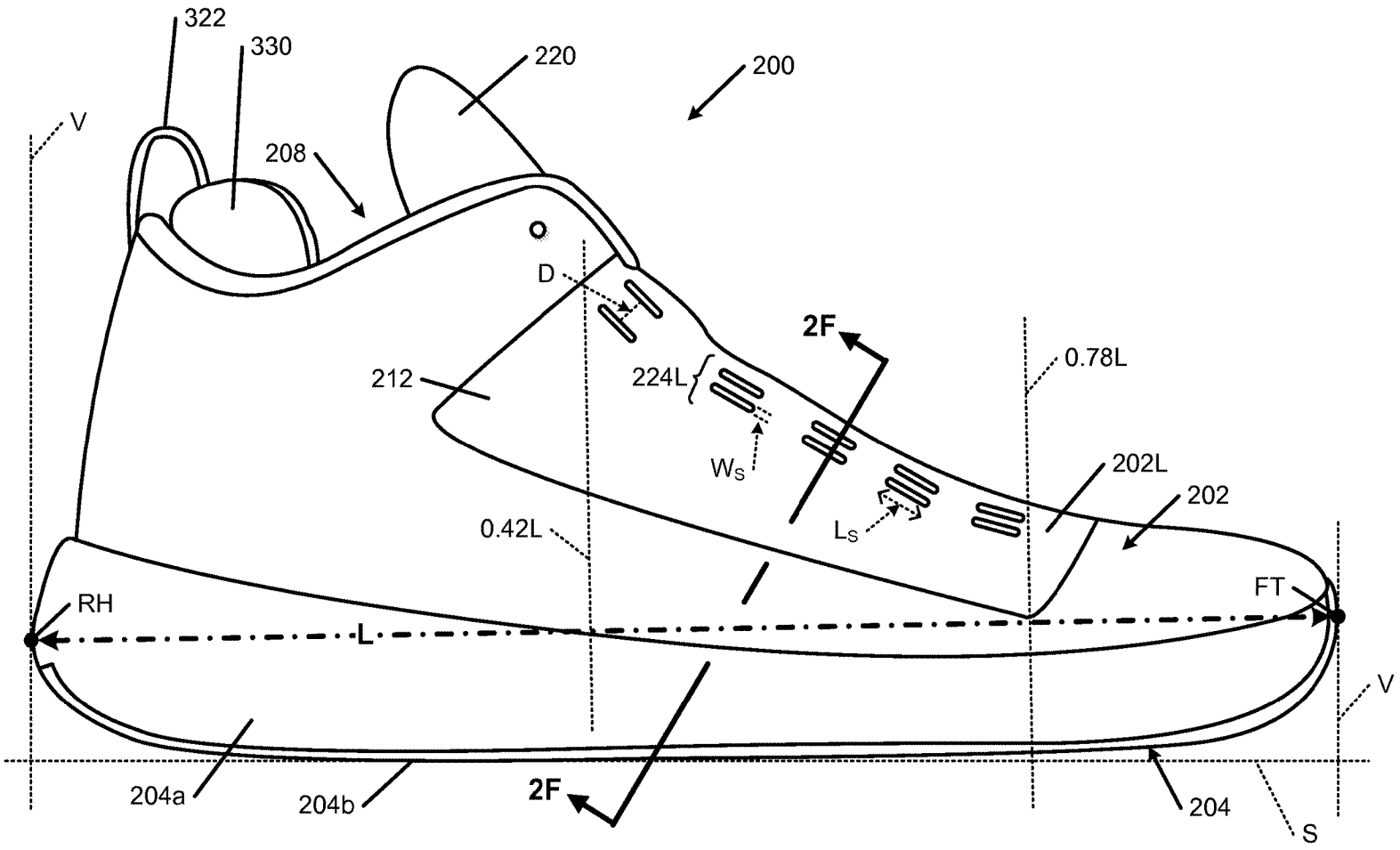
FIGS. 2A through 2G provide various views of articles of footwear in accordance with examples of this invention, including features of securing systems in accordance with examples of this invention.
Figure 2B:
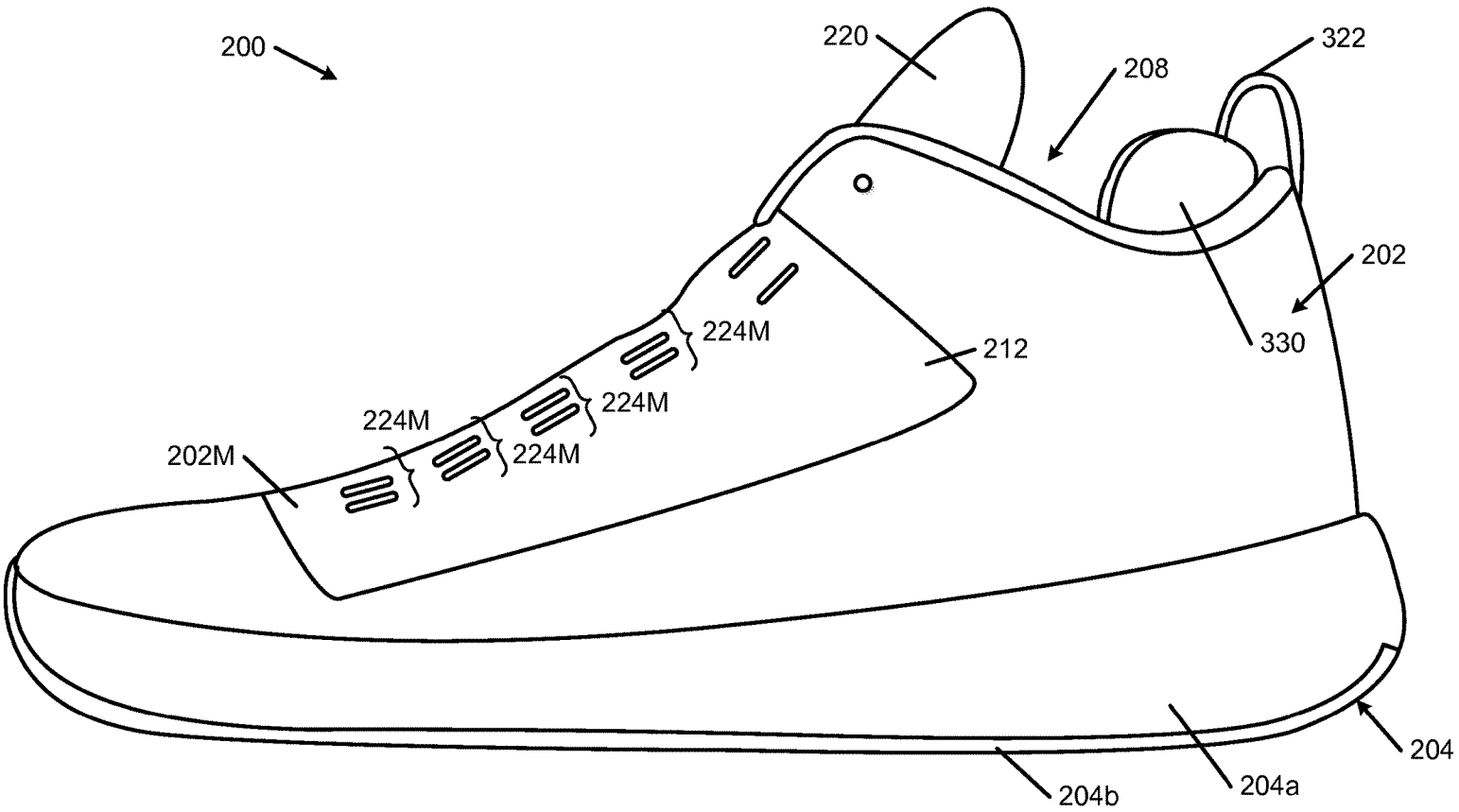
Figure 2C:
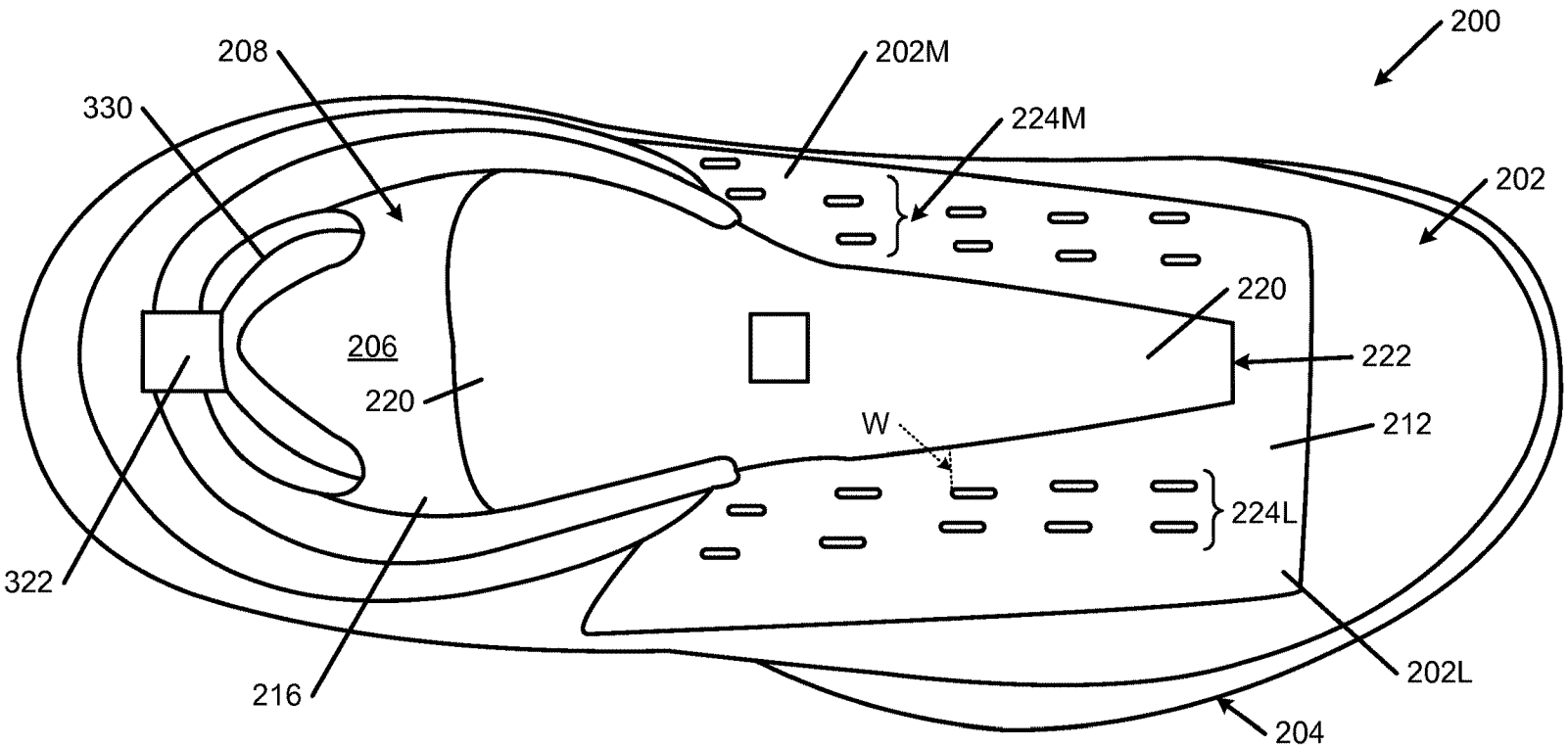
Figure 2D:
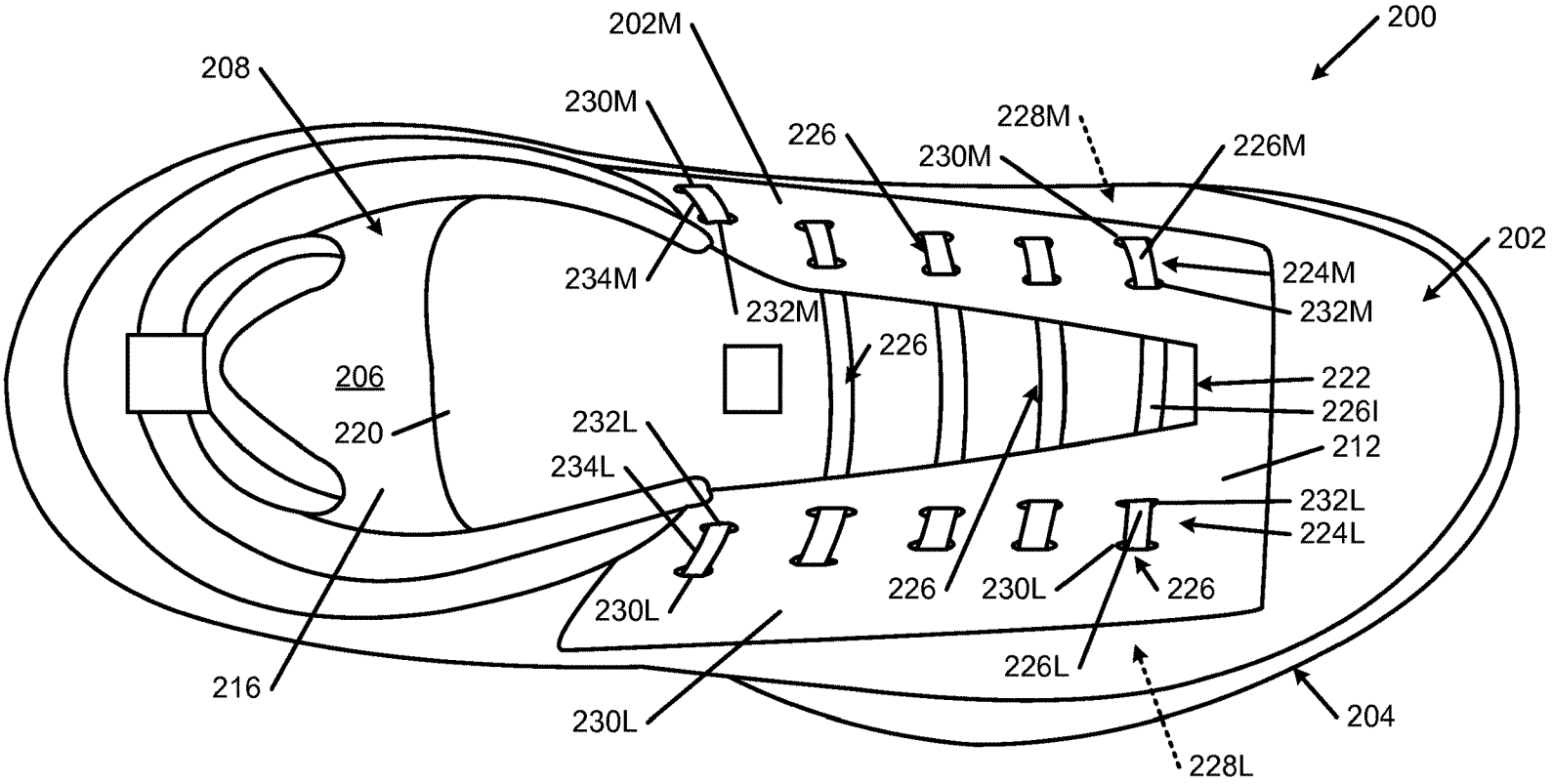
Figure 2E:
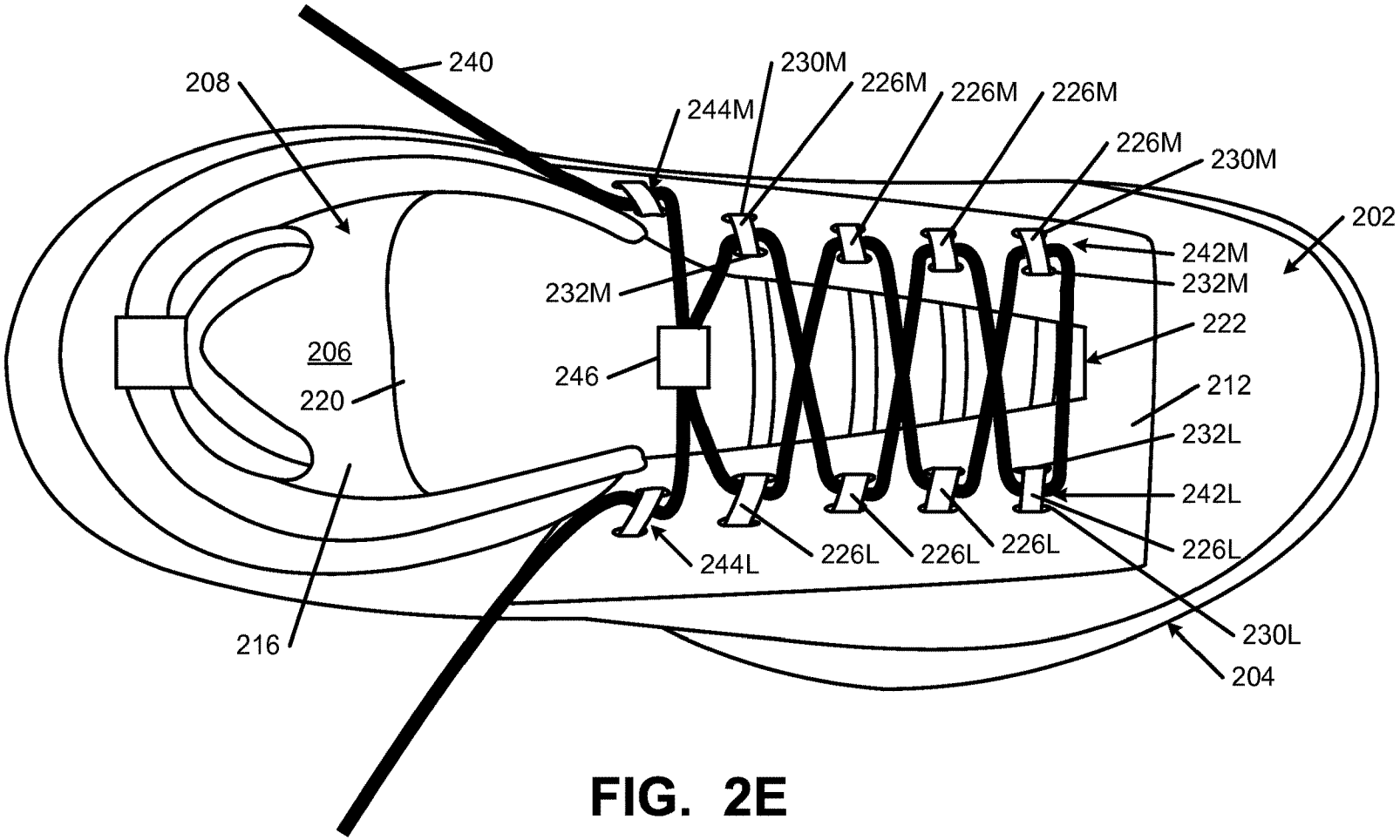
Figure 2F:
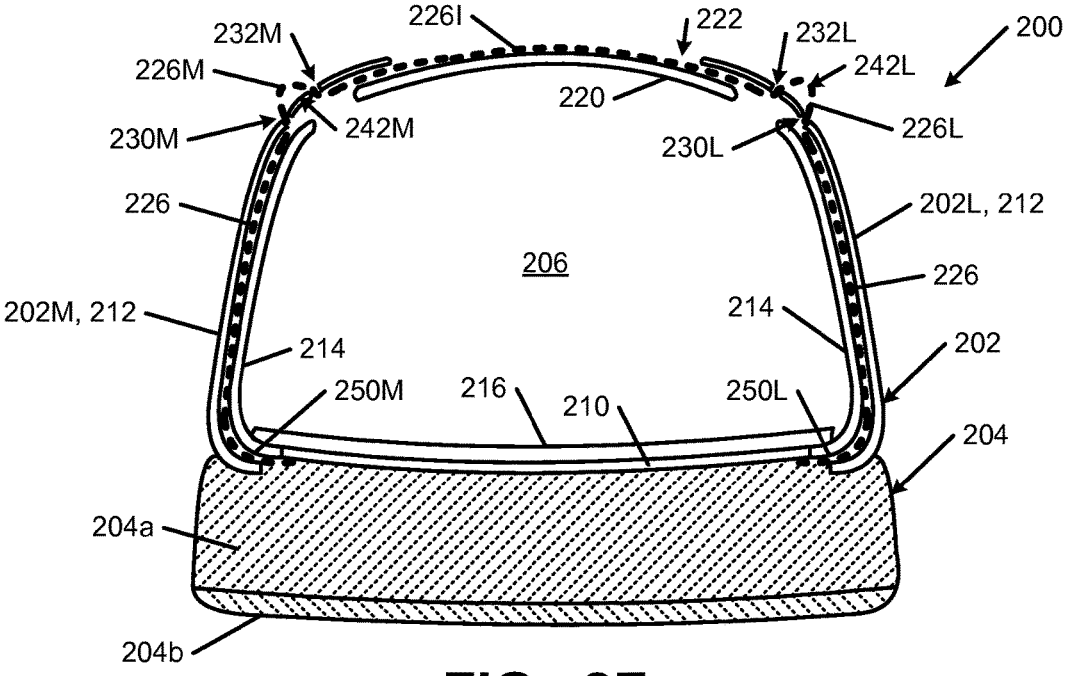
Figure 2G:
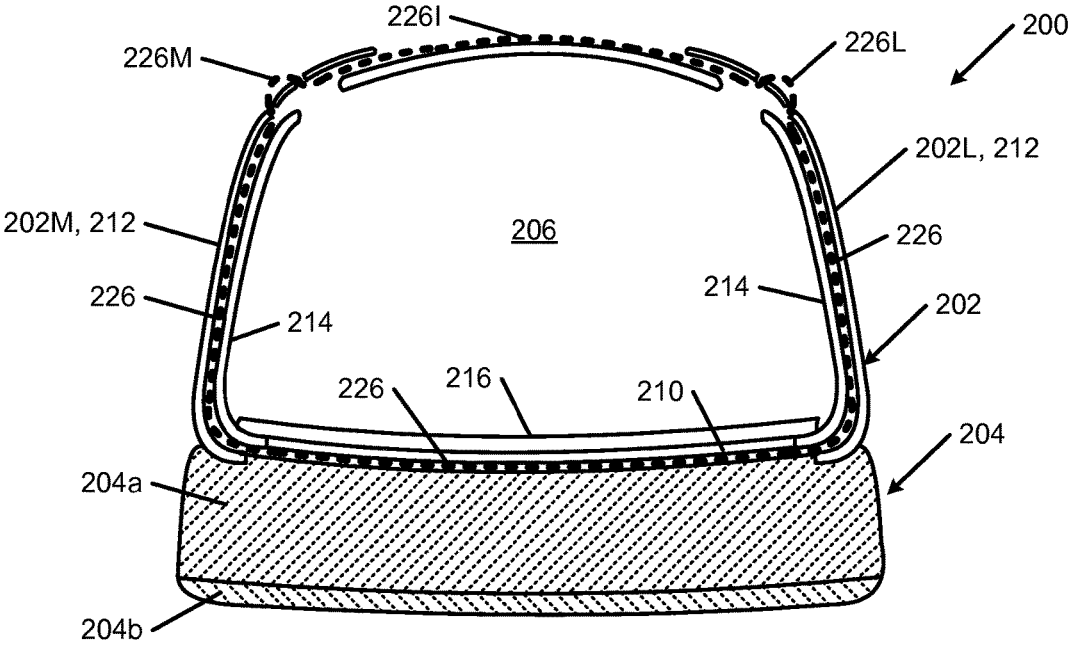

FIGS. 2A-2G show various views of an article of footwear 200 in accordance with some examples of this invention in the form of a high top/mid-rise basketball shoe. More specifically, FIG. 2A shows a lateral side view, FIG. 2B shows a medal side view, FIG. 2C shows a top plan view, FIG. 2D shows a top plan view with the lace engaging straps included in the upper, FIG. 2E shows a top plan view with a lace engaging the lace engaging straps, and FIGS. 2F and 2G show cross sectional views (e.g., at the location of line 2F-2F in FIG. 2A). The article of footwear 200 includes an upper 202 and a sole structure 204 engaged with the upper 202. While this engagement may be made in any desired manner, including in manners conventionally known and used in the footwear art, in this illustrated example, the upper 202 and the sole structure 204 are engaged by cements or adhesives. The upper 202 (optionally along with the sole structure 204) defines an interior chamber 206 for receiving a wearer's foot, and access to this chamber 206 may be made through a foot-insertion opening 208 provided at the top, rearward area of the upper 202.

The upper 202 may have any desired construction and/or may be made from any desired number of parts without departing from this invention. In some examples of this invention, at least some portions of the upper 202 will have a multiple layer construction, with various layers and/or combinations of layers at various locations so as to provide desired functions and/or characteristics, such breathability, abrasion/wear resistance, support for intended use, desired aesthetics, etc.

When present as a multi-layered upper construction, the upper 202 may be produced in any desired manner without departing from this invention, including in conventional manners as are known and used in the footwear art. As a more specific example, if desired, the upper 202 may include one or more "skin" layers 212 (e.g., a thin, thermoplastic elastomer sheet or membrane layer that provides abrasion resistance, support, desired aesthetics, etc.) made from a "no-sew" type material that may be adhered at least at some locations to an underlying mesh layer (or other material layer 214) using an adhesive or hot melt material, e.g., by application of heat and/or pressure. A mesh layer provides a lightweight base and may be left exposed in certain areas to enhance breathability and flexibility at desired areas. As additional examples, if desired, the skin layer(s) 212 may be engaged with the underlying mesh layer (or other material layer) by cements or adhesives and/or by sewn seams. As yet additional examples, if desired, the upper 202 (or portions thereof) may be constructed by bonding various layers of materials using fusing techniques, e.g., as described in U.S. Pat. No. 8,429,835 and U.S. Pat. No. 8,321,984, each of which is entirely incorporated herein by reference.

The upper 202 may include other support elements at desired locations, optionally sandwiched between an exterior layer 212 and an underlying mesh layer and/or other layers 214 of the upper 202. Additionally or alternatively, additional support may be provided as well. For example, a heel counter (e.g., to support a wearer's heel) may be provided as an exterior or interior component in this example footwear structure 200. The heel counter, when present, may be made from a rigid, thin plastic material, such as PEBAX, TPU, fiber reinforced plastics (e.g., carbon fiber or fiberglass), or other polymeric material, and it may include one or more openings (e.g., to control flexibility, breathability, support characteristics; to reduce weight; etc.). As other options, the heel counter or other heel support also may be made (at least in part) from a heavy textile material (e.g., leather), if desired.

If necessary or desired, still additional supports and/or components may be provided in other areas of the shoe 200, such as in the forefoot or toe area (to provide protection and wear resistance, to provide shape support, etc.), at the lateral side or edge area near the fifth metatarsal head, etc. (e.g., to provide support for turning or cutting actions), at the medial side or edge area near the first metatarsal head, at the toe area, etc. These supports may include stiffer, heavier, more abrasion resistant, more durable, and/or harder upper material formed as one of the upper layers and applied to an exterior skin layer 212 or other exterior layer of the upper 202, e.g., via a hot melt adhesive or fusing technique.

Any desired materials may be used in uppers 202 in accordance with at least some examples of this invention, including one or more of: synthetic leather, natural leather, textiles, thermoplastic polyurethanes, any combination of these materials, and/or any combinations of these materials with any of the other materials described above. As another potential feature, if desired, at least some portion(s) of the upper 202 may be formed by a knitting procedure, such as flat knitting, circular knitting, etc. Optionally, at least a majority (or even all) of the upper 202 may be formed using knitting procedures, in at least some examples of this invention. Knitted textile components can be used to provide lightweight, breathable, and comfortable upper constructions.

The sole structure 204 also can take on any desired construction, components, and the like without departing from this invention. The sole structure 204 may include one or more midsole components 204*a* (e.g., an ethylvinylacetate or polyurethane foam material 204*a*) and one or more outsole components 204*b* (e.g., made from rubber, thermoplastic polyurethane, etc.). Additional aspects of the some example sole structures 204 in accordance with this invention will be described in more detail below.

The sole structure 204 may take on a variety of constructions without departing from this invention. As some more specific examples, the midsole 204*a* provided in this shoe 200 may have the form of a polymeric foam material, e.g., located between the outsole structure 204*b* and a bottom surface (e.g., a strobel member 210) of the upper 202, located within the foot-receiving chamber 206 of the upper 202, etc. The footwear 200 also may include an insole or sock liner 216, e.g., in the interior chamber 206 of the footwear 200. Other sole structure options are possible without departing from this invention, such as one or more of: one or more impact-force attenuating columns (akin to SHOX type footwear products available from NIKE, Inc. of Beaverton, Oreg.); one or more fluid-filled bladders (akin to AIR type footwear products available from NIKE, Inc. of Beaverton, Oreg.); one or more lugs and/or sipes (e.g., to provide more natural motion, akin to sole structures used in FREE type footwear products available from NIKE, Inc. of Beaverton, Oreg.); mechanical shock absorbing structures; etc.

FIGS. 2A-2G further illustrate that the article of footwear 200 of this example includes a closure member 220 over at least the instep area. The closure member 220 of this example constitutes a footwear "tongue" like element that includes a fabric component (optionally a stretchable fabric) extending over and closing off the instep area and a soft free end located near the foot-insertion opening 208. The closure member 220 helps moderate the feel of the footwear securing system at the wearer's foot, which will be described in more detail below.

Additional aspects of the illustrated example footwear securing system now will be described in more detail. As shown in FIGS. 2A-2C, this example shoe 200 includes an upper member 202 made from one or more parts and including a medial side portion 202M that extends at least along a medial side of an instep opening 222 of the upper member 202 and a lateral side portion 202L that extends at least along a lateral side of the instep opening 222. The medial side portion 202M and lateral side portion 202L may be provided on the same upper member component part or on different parts. Additionally or alternatively, either or both of the medial side portion 202M and the lateral side portion 202L may be formed of one or more upper member component parts.

As shown, in this illustrated example, each of the medial side portion 202M and the lateral side portion 202L includes multiple pair of slots (pairs shown by reference numbers 224M and 224L, respectively), wherein the slots of each pair 224M, 224L are spaced in a top-to-bottom direction of the respective medial side portion 202M and lateral side portion 202L. While other options are possible, in this illustrated example, each of the medial side portion 202M and the lateral side portion 202L includes five pair 224M, 224L of spaced slots. The spaced slot pairs 224M on the medial side portion 202M generally align with and/or correspond to a pair 224L of spaced slots on the lateral side portion 202L.

In at least some examples of this invention, the slots of the pair 224M, 224L will be separated from one another (i.e., the direct, shortest distance D between a top edge or location of the bottom slot of the pair and the bottom edge or location of the top slot of the pair when the upper component is in an unstressed condition with no external force applied to it) by a distance of no more than 30 mm. In some examples, the spacing D for at least some of the slot pairs 224M, 224L may be no more than 20 mm, no more than 16 mm, or even no more than 12 mm.

While all slot pairs 224M, 224L in a single footwear structure may have the same spacing D, this is not a requirement. Rather, the spacings D may vary along one or both sides of the instep opening 222, e.g., with at least some of the slot pairs 224M and/or 224L having wider spacings D toward the heel as compared to the slot pair spacings D toward the toe. Additionally or alternatively, if desired, the slot pair spacings D on opposite sides of the instep opening 222 may differ (e.g., the slot pair 224M spacings D on the medial side may differ from the corresponding slot pair 224L spacings D on the lateral side). The slot pair 224L, 224M spacings D also are greater than 0 (e.g., and in some examples at least 1 mm, and preferably at least 2 mm or even at least 4 mm).

Also, while variations are possible without departing from the invention, in some examples of this invention, the upper or more central slots of the pairs 224M, 224L may be located within a distance W of the instep opening 222 (i.e., the direct, shortest distance W between a top edge or location of the top or more central slot of the pair and the closest location of the upper portion where the instep opening 222 begins), wherein W may be at least 4 mm, and some examples, at least 6 mm. Additionally or alternatively, W may be less than 20 mm, and in some examples, less than 15 mm. In some examples, the dimension W may be within a range of 4 mm to 20 mm, and in some example, within a range of 6 mm to 15 mm.

Also, while the dimension W may be the same for all upper or more central slots of pairs 224L, 224M, this is not a requirement. Rather, the spacings W may vary along one or both sides of the instep opening 222, e.g., with at least some of the upper or more central slots of slot pairs 224M and/or 224L having wider spacings W than others. Additionally or alternatively, if desired, the spacings W on opposite sides of the instep opening 222 may differ (e.g., the slot spacing W on the medial side may differ from the corresponding slot spacing W on the corresponding lateral side slot).

While FIGS. 2A-2C show the slots of the pairs 224M, 224L as generally rounded rectangular or oval shape and arranged with generally parallel facing edges, these also are not requirements. Rather other slot shapes and sizes may be used without departing from this invention, and other relative arrangements of the slots of a pair 224M, 224L may be used without departing from this invention. The slot spacing D referred to above constitutes the closest distance between the facing sides or edges of the slots of the pair 224M, 224L when the upper material in which the slots are defined is held taut but not under a significant tensile force (e.g., under less than 1 kg tensile force).

While the slot sizes may vary, in at least some examples of this invention, the slots will have a largest dimension (e.g., a length dimension $L_S$, see FIG. 2A) of less than 25 mm, and in some examples, less than 20 mm or even less than 15 mm. Furthermore, in some examples, this length dimension $L_S$ for at least some slots will be at least 4 mm, and in some examples, at least 6 mm or even at least 8 mm. The dimension between at least some portions of opposite sides of a slot (the width dimension $W_S$, thereby defining the size of the gap in the slot; see FIG. 2A) also may vary, and in some examples, will be less than 5 mm or even less than 3 mm. Furthermore, not all slots of a pair 224L, 224M and/or all slots on the medial side and/or the lateral side need have the same length and/or width dimension characteristics (e.g., slot dimensions may vary from slot to slot in a given shoe structure). The slots may be sized so as to generally correspond in size and/or shape (e.g., slightly larger) to the size of the strap portion that extends through the slot (e.g., slot length and/or slot width dimensions within 0.5 to 3 mm of the corresponding width and thickness of the strap portion that will extend through the slot).

While other locations may be possible, in some examples of this invention, at least some (and optionally all) slot pairs 224M, 224L will be located rearward of a plane perpendicular to the longitudinal direction L and located at a position 0.85L forward from the rearmost heel RH location (and in some examples, rearward of a perpendicular plane located at the 0.8L position). Additionally or alternatively, at least some (and optionally all) slot pairs 224M, 224L will be located forward of a plane perpendicular to the longitudinal direction L and located at a position 0.3L forward from the rearmost heel RH location (and in some examples, forward of a perpendicular plane located at the 0.35L position).

FIGS. 2A-2C show the upper 202 without lace engaging structures in accordance with at least some examples of this invention engaged with it (in order to avoid obscuring features of the upper 202). Turning now to FIG. 2D, the upper 202 is shown with lace engaging components engaged with the slot pairs 224L, 224M. As shown in FIG. 2D, for each corresponding slot pair 224L, 224M on opposite sides of the instep opening 222, the lace engaging component for each of those corresponding slot pairs includes a continuous, uninterrupted strap portion 226 that extends: (a) from a location 228M inside an exterior surface of the upper 202 and beneath the medial side portion 202M (optionally between layers of the upper 202 and/or from a location between the upper 202 and the sole structure 204), (b) through the lower medial slot 230M of the pair 224M to a location outside the upper 202 exterior surface, (c) from the lower medial slot 230M to the upper or more central medial slot 232M (such that the strap portion 226 is exposed between the lower medial slot 230M and the upper or more central medial slot 232M), (d) back beneath the medial side portion 202M and beneath the exterior surface of the upper 202, (e) across the instep opening 222 (and optionally above the tongue member 220 and/or exposed at the exterior of the upper 202 once beyond the edge of the medial side portion 202M at the instep opening 222), (f) beneath the lateral side portion 202L, (g) through the upper or more central lateral slot 232L to a location outside of the upper 202 exterior surface, (h) from the upper or more central lateral slot 232L to the lower lateral slot 230L (such that the strap portion 226 is exposed between the upper or more central lateral slot 232L and the lower lateral slot 230L), and (i) to a location 228L inside an exterior surface of the upper 202 and beneath the lateral side portion 202L (optionally between layers of the upper 202 and/or to a location between the upper 202 and the sole structure 204). Thus, the strap portion 226 extends continuously and uninterrupted from the lateral side to the medial side of the upper 202 and across the instep opening 222 of the upper 202. In this manner, the strap portion 226 includes at least three exposed regions, namely: a lateral lace engaging region 226L, a medial lace engaging region 226M, and an instep spanning region 226I.

This same type of strap 226 orientation and positioning may be provided for one or more of the other strap portions 226 in the footwear upper 202 structure. In the example shown in FIG. 2D, this same type of lace engaging strap portion 226 and arrangement (extending and being exposed between slots of the medial and lateral side slot pairs 224M, 224L and extending across and exposed at the instep opening 222) is provided in the bottom four sets of corresponding lateral side and medial side slot pairs 224L, 224M.

While not a requirement, the rearmost lace engaging structure in this example structure that includes strap portions differs from the strap portions 226 shown in the four forward lace engaging structures. More specifically, as shown in FIG. 2D, the rearmost lace engaging structure includes separate strap portions 234M and 234L on opposite sides of the instep opening 222 (i.e., no strap portion extends across the instep opening 222 in this rearmost lace engaging structure that includes strap portions 234M, 234L). Like the lace engaging structures 226L and 226M, however, strap portions 234L and 234M extend from beneath upper components 202L, 202M, respectively, to locations between (and are exposed between) upper or more central slots 232L, 232M and lower slots 230L, 230M of these slot pairs 224L, 224M. Rather than extend across the instep opening 222, the strap portions 234L, 234M either terminate once back beneath the upper components 202L, 202M (e.g., and are attached to the upper 202L, 202M, and/or to itself, e.g., by sewing) and/or extend back down the same side of the upper component from which they originated (and are secured to upper 202, the sole structure 204, and/or to another part of the footwear structure).

FIG. 2E illustrates the upper 202 of FIGS. 2A-2D with a lace 240 engaged with medial lace engaging openings 242M defined by the exposed medial side strap portions 226M between the pairs of medial slots 230M and 232M and the material of the upper portion 202M located between the pairs of medial slots 230M and 232M. On the opposite side of the instep opening 222, the lace is 240 engaged with lateral lace engaging openings 242L defined by the exposed lateral side strap portions 226L between the pairs of lateral slots 230L and 232L and the material of the upper portion 202L located between the pairs of lateral slots 230L and 232L. Additionally, if desired, the lace 240 may extend through: (a) lace engaging opening 244L defined between the lateral strap portion 234L and the material of the upper member 202L between the slot pairs 230L, 232L at the lateral strap portion 234L and (b) lace engaging opening 244M defined between the medial strap portion 234M and the material of the upper member 202M between the slot pairs 230M, 232M at the medial strap portion 234M. Also, if desired, the lace 240 may pass through a tongue securing element 246 (e.g., a flap of material, an opening defined in or engaged with the tongue 220, etc.) to help better position the tongue 220 and/or keep it from falling into the interior 206 of the footwear 200. If desired, at least some of the strap portions 226I may extend through similar tongue securing elements 246.

The strap portion(s) 226 and/or 234 may be incorporated into the footwear structure during construction of the upper 202 and/or fixed between the upper 202 and the sole structure 204 of the article of footwear 200. FIG. 2F shows one example cross sectional view taken along a strap portion 226 (without a lace 240 present). As shown, in this example structure, the lace engaging components 242M, 242L formed in part by the strap portion(s) 226 include a continuous strap portion 226 that extends from a first location 250M (e.g., a fixed location between the upper 202 and the sole structure 204). The strap portion 226 extends inside the exterior surface of the upper component 202M (optionally between layers 212, 214 of the upper 202) and beneath the medial side portion 202M and through the lower medial slot 230M of the slot pair 224M to a location outside the upper 202 exterior surface. The exposed strap portion is shown as 226M. From there, the strap portion 226 extends back beneath the upper component 202M through the upper or more central slot 232M. The strap portion 226 again becomes exposed when it emerges from beneath the upper portion 226M at the instep opening 222, and the exposed strap portion 226I extends across the instep opening 222 to the lateral upper portion 202L. Upper portions 202M and 202L may be part of a single component part, separate parts, and/or made from multiple parts. While FIG. 2F shows strap portion 226I located outside of the tongue member 220, the tongue member 220 could be outside of the strap portion 226, if desired. As other options, if desired, one or more of the strap portions 226I may be engaged with the tongue member 220 and/or extend through or between layers of the tongue member 220.

At the lateral upper portion 202L, the strap portion 226 again extends beneath the exterior surface of the upper 202 and emerges at the upper or more central lateral slot 232L. Note exposed strap portion 226L. There, the lateral lace engaging area 242L is defined between the strap portion 226L and the material of the upper portion 202L between the slots 230L, 232L. From there, the strap portion 226 again extends beneath the lateral upper portion 202L (and optionally between layers of the upper 202) to a lateral side location 250L where it is optionally fixed between the upper 202 and the sole member 204. Interior upper layer 214 is optional and/or need not be provided at all areas of the upper 202, thereby partially leaving at least some parts of strap portions 226, 234L, and/or 234M exposed in the interior 206 of the upper 202.

FIG. 2G shows a cross sectional view of an alternative strap 226 construction that may be provided for one more strap portions on an article of footwear in accordance with at least some examples of this invention. Rather than terminating and being fixed at the lateral and medial bight lines between the upper 202 and the sole structure 204 (e.g., at locations 250L, 250M in FIG. 2F), in this example structure, the strap portion 226 extends continuously across the upper 202, beneath the plantar support surface (e.g., optionally beneath insole or sock liner 216 and/or strobel member 210) from the lateral side to the medial side. In this manner, strap portion 226 of this example extends continuously, 360° around the circumference of the upper 202. Any one or more of strap portions 226 and 234L, 234M may extend around the plantar support surface in this manner.

While each of strap portions 226 and 234 appear to be separate components at their exposed areas, in reality, two or more of the illustrated strap portions 226, 234 may be interconnected to one another, e.g., by a web of material that may be located beneath the plantar surface of the wearer's foot and/or at least partly within the exterior surface of the upper 202. In other words, a base area may be provided (e.g., beneath the wearer's foot, partially around the sides of the foot, etc.) and: (a) strap portions 226 may appear as straps of material that extend continuously between the medial and lateral sides of the base area, and/or (b) strap portions 234 may appear as separate straps extending from opposite sides of the base area (with free ends that are later fixed to the upper or other footwear component). In this manner, the base area for strap portions 226 and/or 234 may appear similar to those included in at least some of the foot stabilizer systems shown in U.S. Pat. No. 8,578,632 B2, which patent is entirely incorporated herein by reference (note for example, strap system component 3122 in FIG. 40 of the '632 Patent).

Figure 3B:
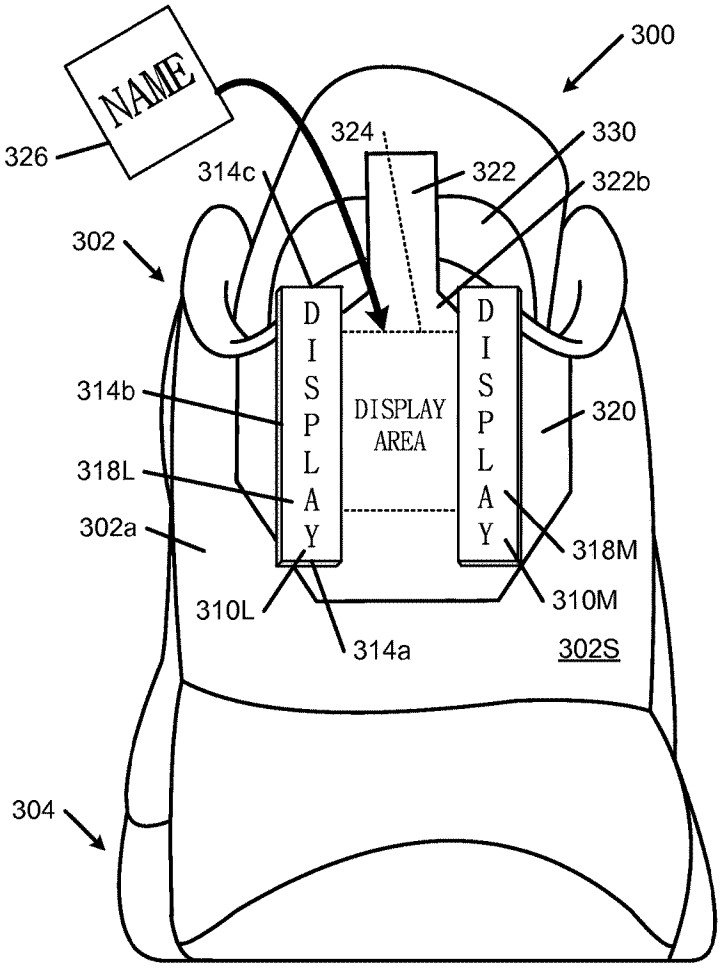
FIGS. 3A and 3B illustrate example features of a heel oriented enclosed area, e.g., for including display areas and/or customization features, such as graphics, text, etc.
Figure 3A:
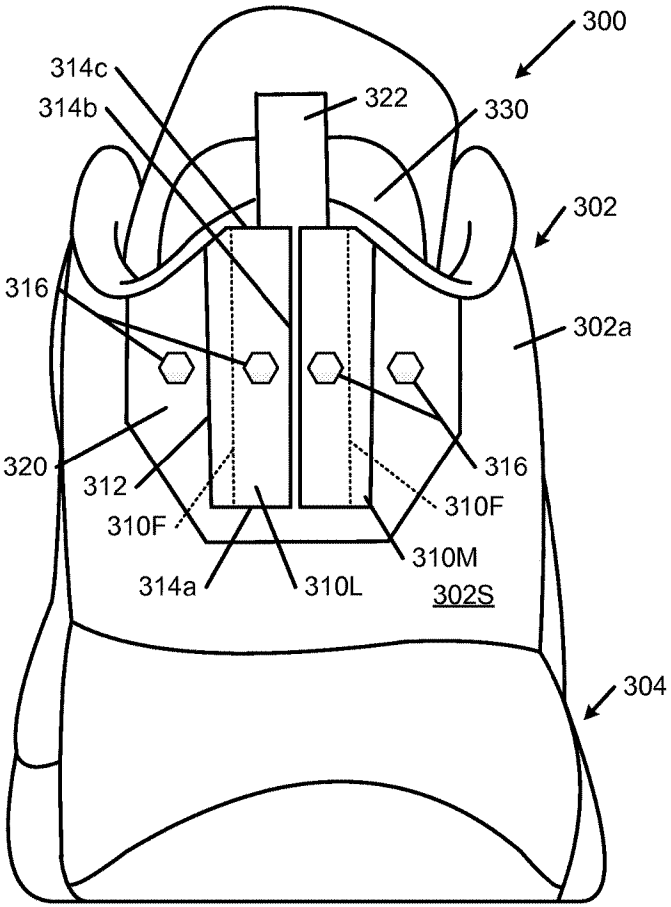

FIGS. 3A and 3B illustrate additional aspects of this invention, and the features of the footwear structures 300 shown in FIGS. 3A and 3B also may be used in the upper/foot-covering member and footwear/foot-receiving device structures described above, e.g., in conjunction with FIGS. 2A through 2G. FIGS. 3A and 3B show rear heel views of an article of footwear 300 in accordance with this aspect of the invention. The article of footwear 300 includes an upper 302 and a sole structure 304, which may have any desired constructions and/or configurations, including the constructions and/or configurations described above and/or conventional constructions and configurations as are known and used in the art.

In accordance with this example of the invention, the upper 302 includes an upper component 302*a* comprising one or more parts that extends around a rear heel area of the upper 302 and has an exposed exterior surface 302S. The upper component 302*a* of this example includes a first flap member (e.g., lateral flap member 310L) engaged or integrally formed with it. As shown (e.g., by comparing FIGS. 3A and 3B), the first flap member 310L includes an outer perimeter having a secured portion (e.g., fixed edge 312) and an unsecured portion (e.g., edge 314*b* and at least portions of edges 314*a*, 314*c*).

While not a requirement, in this illustrated example, both the medial side and lateral side of the upper 302 in the rear heel area includes a flap member engaged or integrally formed with it. In this illustrated example, the flap member 310M is a mirror image of the flap member 310L described above (e.g., including similar secured portions, unsecured portions, edges, etc.). However, if desired, flap members 310M, 310L may differ from one another, e.g., in size, shape, areas, operation, etc. Also, in this illustrated example, the flap members 310L, 310M are mounted to or formed as part of a common rear heel upper component 320 that spans across a rear centerline of the upper 302, e.g., component 320 spans from the medial side to the lateral side of upper 302 around the rear heel area. As another option, if desired, flap members 310L, 310M could be provided on separate rear heel upper components 320 (that may have mirror image shapes, the same shapes, or different shapes). The rear upper component(s) 320 and/or flap member(s) 310 may span any desired vertical height of the upper 302 and/or around any desired portion or proportion of the sides.

In use, the unsecured portion(s) of the flap member(s) 310L, 310M is (are) movable between a closed position (e.g., as shown in FIG. 3A) in which one or more display areas are at least partially concealed and an open position (as shown in FIG. 3B) in which one or more display areas are exposed. The flap member(s) 310L, 310M may move or rotate open about fold lines 310F or other rotation supporting structures (e.g., hinges, couplings, etc.). Optionally, if desired, a securing system 316 (e.g., a hook-and-loop type fastener, a snap, a button, a "sticky" component, etc.) may be provided on the flap 310L, 310M, on the rear heel upper component(s) 320 (if any), and/or on the upper member 302*a* to help hold the flap member(s) 310L, 310M, in the open position.

The "display areas" may be provided on various different surfaces or other components without departing from this invention. For example, as shown in FIG. 3B, one or more "display areas" may be provided as the interior surface(s) 318L, 318M of one or more of the flap members 310L, 310M, which become exposed when the flap members 310L, 310M are in their open positions. Additionally or alternatively, if desired, the display area may constitute one or more of the surface 302S of the upper 302*a*, the surface of the rear heel upper component 320 on which the flaps are mounted, an exterior surface 322*b* of a heel tab component 322 (e.g., a heel loop that may help the wearer pull on the shoe), etc. (labeled "Display Area" in FIG. 3B). As another additional or alternative option, one or more of the display areas may include a pocket 324 or other suitable structure that would enable a user, manufacturer, or other to engage their own desired display element 326 (e.g., a card 326 or other object with any desired pictures, graphics, or textual information, etc.). As yet additional options or alternatives, the display area may include one or more light sources or other electronics.

The various flap members 310L, 310M, rear heel upper components 320 (if any), display areas, and the like, may take on a wide variety of sizes, shapes, and aesthetic design appearances without departing from this invention. For example, in this illustrated example, the system includes two flap portions of substantially the same size, shape, structure, etc. In this example, when the flap members 310L, 310M are in their closed positions, the unsecured portions 314*b* of the two flap members 310L, 310M lie adjacent one another, extend substantially in parallel (in the vertical direction in this illustrated example), and meet (optionally with a small gap separating edges 314*b* as shown in this illustrated example) at the rear central area of the upper 302. Many other design options are possible, including, for example: flap members 310L, 310M of different sizes and/or shapes (e.g., squares, triangles, trapezoids, parallelograms, other shapes); rear heel upper components 320 of different sizes and/or shapes (e.g., triangles, trapezoids, rectangles, other shapes, etc.); abutting unsecured edges 314*b*; overlapping unsecured edges 314*b*; non-parallel unsecured edges 314*b*; non-vertical unsecured edges 314*b*; curved unsecured edges 314*b*; etc. In some examples, the major surface area of the movable portions of the flaps 310L, 310M (e.g., the areas of surfaces 318L, 318M) may be within a range of 0.5 $in^2$ to 3 $in^2$, and in some examples, 0.5 $in^2$ to 2 $in^2$. The overall area exposed when the flap member(s) 310L, 310M are in the open position(s) may be in the range of 0.5 $in^2$ to 6 $in^2$, and in some examples, in the range of 0.75 $in^2$ to 5 $in^2$.

Also, as noted above, if desired, the flap member(s) 310L, 310M may at least partially conceal a surface 322*b* of a heel tab 322 when in the closed position(s). The heel tab 322 may be a loop of material that includes a base surface 322*b* (e.g., a thin sheet of fabric) that extends downward into the area behind the flap member(s) 310L, 310M. The heel tab 322 may extend to and into the foot-receiving opening 208 of an article of footwear and engage a rear heel/Achilles comfort element 330 provided as another portion of the upper 302. Note also FIGS. 2A-2C. While FIGS. 3A and 3B illustrate the flap members 310L, 310M at the extreme rear heel area of the upper 302, the same or similar flap members could be provided at other locations on a footwear structure, such as along the lateral and/or medial sides, on a tongue member, on the instep area (e.g., over the forefoot/toes), etc.

Figure 4:
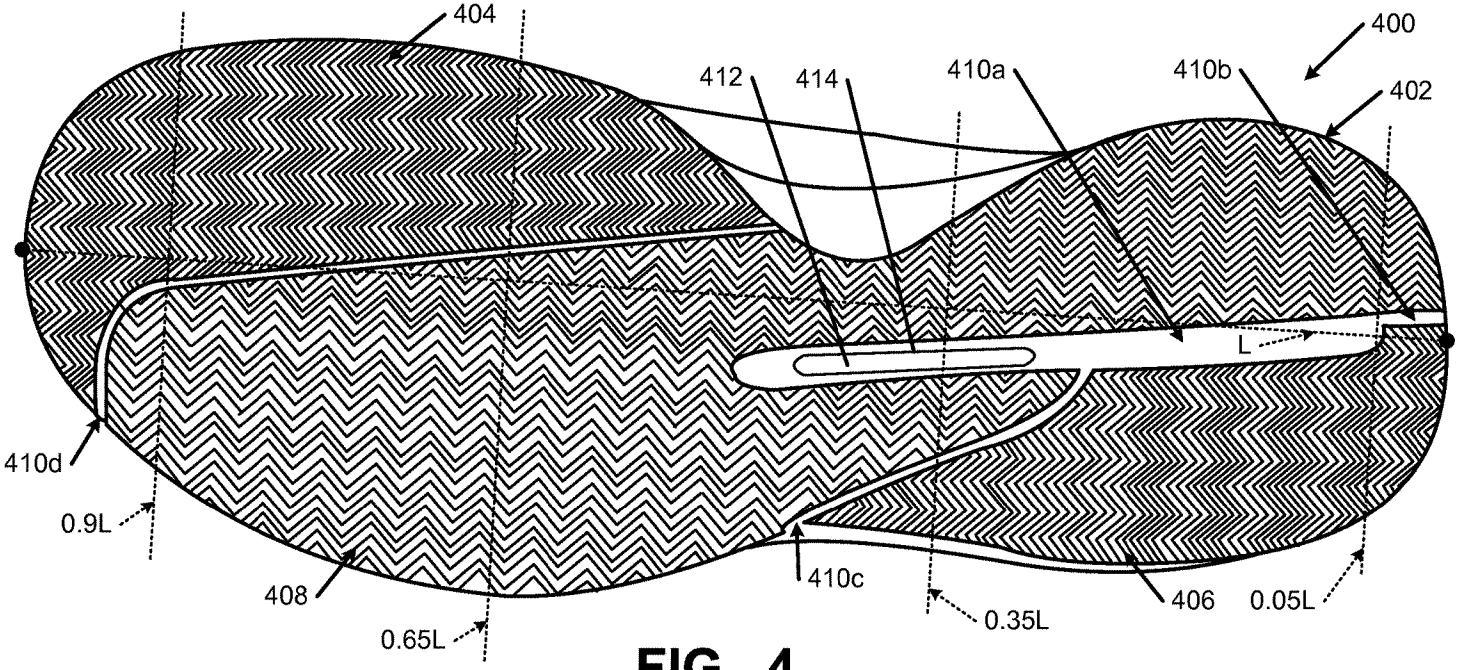
FIG. 4 illustrates example features of a herringbone type sole structure in accordance with at least some examples of this invention.

FIG. 4 illustrates a bottom surface of an example sole structure 400 that may be included in articles of footwear in accordance with at least some examples of this invention, including the example structures described above in conjunction with FIGS. 2A through 3B (e.g., as outsole component 204*b* and/or at least part of sole structure 304). In this illustrated example of this aspect of the invention, the sole structure 400 includes two or more herringbone type contact surface portions wherein the herringbone patterns of at least two of the herringbone contact surface portions are oriented in different directions.

Figure 4A:
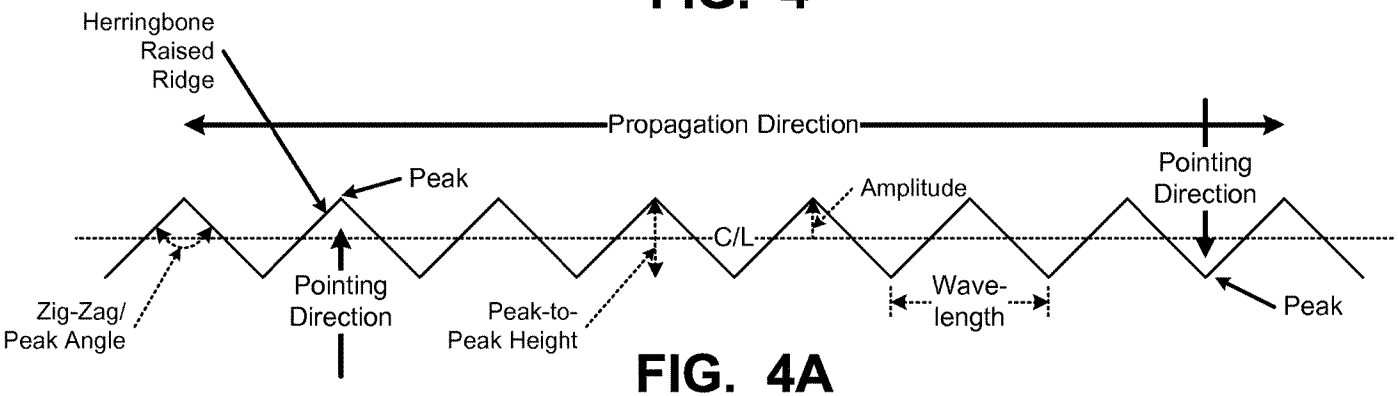
FIG. 4A is provided to help illustrate and explain certain terminology used in the description of FIG. 4.

A "herringbone" pattern, as that term is used herein, means a tread pattern with a plurality of separated raised ridges that extend in a zig-zag pattern or fashion (e.g., as shown in FIG. 4). Thus, the raised ridges are separated by similarly zig-zag shaped grooves or recesses. The raised ridges can be defined by one or more of: (a) a "propagation direction," which in this context means the direction along which the raised ridges/grooves extend in a continuous manner (e.g., moving along the zig-zag pattern on a raised ridge) and (b) a "peak" pointing direction, which in this context means the direction to which the "peaks" or intersections of the zig-zag raised ridge structures point. Note FIG. 4A for an explanation/illustration of various terms.

In the example of FIG. 4, one contact surface portion 402 of interest is located at least at a medial, heel area of the sole structure 400. This portion 402 includes a herringbone traction element structure in which the herringbone/raised ridge propagation direction extends in a heel-to-toe direction and the plurality of peaks of the herringbone traction element structure point toward the medial and lateral sides of the sole structure 400. This is the area of a sole structure 400 to which force is often applied at least partially in a sideways direction, e.g., when a wearer attempts a rapid turn or cutting action. By having the plurality of peaks face toward the sides of the sole structure, a larger surface area is provided to engage the contact surface and/or against which the user can push in the sideways direction to complete the turn or cutting maneuver. The herringbone traction element structure of portion 402 may be provided to substantially cover the contact surface of the medial heel area of the sole structure 400, e.g., to cover at least 75% of the contact surface area defined by: (a) a vertical plane parallel to the longitudinal direction L, (b) a plane perpendicular to the longitudinal direction and located at 0.05L, (c) a plane perpendicular to the longitudinal direction and located at 0.35L, and (d) the medial edge of sole 400 and/or contact surface.

Another contact surface portion 404 of interest in this sole structure 400 is located at least at the medial, forefoot area. This portion 404 includes a different herringbone traction element structure compared to that of portion 402 in that portion 404 includes a different herringbone propagation direction and a different peak pointing direction. More specifically, in contact surface portion 404, the herringbone propagation direction extends in a medial side-to-lateral side direction and the plurality of peaks point toward heel and toe ends of the sole structure 400. This portion 404 of the sole structure 400 supports at least the first metatarsal head area (e.g., the "big toe" joint) of the wearer's foot. This is the area of the foot that the user typically uses to push off for a step or jump (and applies a generally longitudinal force). By having the plurality of peaks face toward the front and rear of the sole structure 400, a larger surface area is provided to engage the contact surface and/or against which the user can push in the longitudinal direction to provide a stable base to initiate a step or jump. The herringbone traction element structure of portion 404 may be provided to substantially cover the contact surface of the medial forefoot area of the sole structure 400, e.g., to cover at least 75% of the contact surface area defined by: (a) a vertical plane parallel to the longitudinal direction L, (b) a plane perpendicular to the longitudinal direction and located at 0.65L, (c) a plane perpendicular to the longitudinal direction and located at 0.95L, and (d) the medial edge of sole 400 and/or contact surface.

The example sole structure of FIG. 4 further shows a third contact surface portion 406 located at a lateral, heel area that includes a different herringbone traction element structure from that included in the medial heel area 402. More specifically, lateral heel contact surface portion 406 has a herringbone traction element structure that includes a herringbone propagation direction extending in a medial side-to-lateral side direction and a plurality of peaks pointing toward heel and toe ends of the sole structure 400. This portion 406 of the sole structure 400 supports at least the lateral heel area of the wearer's foot and can receive substantial force, e.g., when a user tries to stop quickly and/or when the user moves on a downward incline. By having the plurality of peaks face toward the front and rear of the sole structure 400, a larger surface area is provided to engage the contact surface and/or against which the user can apply force when stopping, reversing directions, and/or moving downward. While not necessary, if desired, the propagation directions and/or the pointing directions in areas 404 and 406 may be parallel. The herringbone traction element structure of portion 406 may be provided to substantially cover the contact surface of the lateral heel area of the sole structure 400, e.g., to cover at least 75% of the contact surface area defined by: (a) a vertical plane parallel to the longitudinal direction L, (b) a plane perpendicular to the longitudinal direction and located at 0.05L, (c) a plane perpendicular to the longitudinal direction and located at 0.3L, and (d) the lateral edge of sole 400 and/or contact surface.

FIG. 4 further illustrates that various contact surface portions of the sole structure 400 may be separated from one another by gaps or grooves 410*a*-410*d*. The gaps or grooves 410*a*-410*d* may have any desired sizes, depths, shapes, or other configurations, including, if desired, sizes and arrangements necessary to affect the flex properties of the sole structure 400 (e.g., to enhance or support more natural motion of the sole structure 400). In the example shown in FIG. 4, the large generally heel-to-toe oriented groove 410*a* includes a portion that extends completely through the sole structure 400 (optionally through one or both of any present midsole and/or outsole components) and leaves a bottom surface 412 of a footwear upper (e.g., a strobel member) exposed through an opening 414.

The large groove 410*a* in this illustrated example sole structure 400 extends from a central rear heel area to a central midfoot or arch area (and terminates within the sole structure 400), and the opening 414 is provided in the central midfoot or arch area. This large groove 410*a* separates contact surface portions 402 and 406 and separates a portion of contact surface portion 402 from itself. A somewhat smaller groove segment 410*b* extends rearward to the extreme rear heel position (0L) and separates contact surface portions 402 and 406 at the extreme rear heel.

FIG. 4 further shows a separating groove 410*c* that extends from a lateral edge of the sole structure 400 in the midfoot or arch area rearward and inward to the large groove 410*a*, where grooves 410*a* and 410*c* meet or intersect. Grooves 410*a* and 410*c* in this example meet in the forward heel area (e.g., proximate to a perpendicular plane located at about 0.25L). The groove 410*c* separates the different herringbone traction element structure in area 406 from the contact surface portion located in the lateral midfoot area (e.g., from herringbone traction element structures like those of areas 402 and 408).

Groove 410*d* extends from a lateral forefoot area in a sideways direction to an abrupt turn or curve location at the lateral or central forefoot area and then in a rearward direction to a medial midfoot/arch area. This groove 410*d* separates the herringbone traction element structure in area 404 from different contact surface structures (e.g., from different herringbone traction element structures in area 408, in the midfoot area, etc.).

In the example of FIG. 4, the first contact surface portion 402 (and the herringbone traction elements and patterns described therein) extend continuously from the rear, medial heel area, across an arch area of the sole structure 400, to a lateral, forefoot area 408. Thus, lateral forefoot area 408 in this example structure 400 includes the same herringbone traction pattern orientation, propagation direction, and pointing directions as the medial heel area 402. Other options are possible. For example, if desired, a gap could be provided between the medial rear heel area 402 and the lateral forefoot area 408 (e.g., in the arch area). In some sole structures, no herringbone structure will be provided in the central arch area of the sole structure 400. As other options, contact surface portion 408 may have a different type of traction element structure and/or a different herringbone propagation direction and/or pointing direction from that utilized in portion 402 (and/or from those utilized in other areas of the sole structure 400).

The herringbone features may be the same or different in the various different areas of the sole structure 400 without departing from this invention. For example, the herringbone period (or wavelength), amplitude, and/or peak-to-peak height may be the same or different in the various areas and/or the herringbone zig-zag or peak angle(s) may be the same or different in the various areas. Additionally or alternatively, if desired, the herringbone period, amplitude, peak-to-peak height, and/or zig-zag or peak angles may vary over the area of a single portion 402-408 and/or over the propagation direction of a single raised ridge waveform (e.g., with a different period or angles at one part of a herringbone waveform as compared to another part of that same waveform).

II. CONCLUSION

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

What is claimed is:

1. An upper for an article of footwear, comprising:

an upper member made from one or more parts and including a medial side portion that extends at least along a medial side of an instep opening of the upper member and a lateral side portion that extends at least along a lateral side of the instep opening, wherein the medial side portion includes: a first pair of medial slots spaced apart from one another in a direction extending away from the medial side of the instep opening and a second pair of medial slots spaced apart from one another in the direction extending away from the medial side of the instep opening; and wherein the lateral side portion includes: a first pair of lateral slots spaced apart from one another in a direction extending away from the lateral side of the instep opening and a second pair of lateral slots spaced apart from one another in the direction extending away from the lateral side of the instep opening;

a first strap portion that extends continuously: (a) from a location on a medial side of the upper member where the upper member is configured to engage a sole structure, (b) between and through each of the first pair of medial slots, (c) across the instep opening, (d) between and through each of the first pair of lateral slots, and (e) to a location on a lateral side of the upper member where the upper member is configured to engage the sole structure, wherein the first strap portion is exposed at least between the first pair of medial slots and between the first pair of lateral slots; and a second strap portion that extends between and through each of the second pair of medial slots and the second pair of lateral slots, wherein the second strap portion is exposed at least between the second pair of medial slots and between the second pair of lateral slots, and wherein the second strap portion extends across the instep opening.

2. The upper for an article of footwear according to claim 1, wherein the medial side portion further includes a third pair of medial slots spaced apart from one another in the direction extending away from the medial side of the instep opening, wherein the lateral side portion further includes a third pair of lateral slots spaced apart from one another in the direction extending away from the lateral side of the instep opening, and wherein the upper further comprises:

a third strap portion that extends between and through each of the third pair of medial slots and the third pair of lateral slots, wherein the third strap portion is exposed at least between the third pair of medial slots and between the third pair of lateral slots, and wherein the third strap portion extends across the instep opening.

3. The upper for an article of footwear according to claim 2, wherein the medial side portion further includes a fourth pair of medial slots spaced apart from one another in the direction extending away from the medial side of the instep opening, wherein the lateral side portion further includes a fourth pair of lateral slots spaced apart from one another in the direction extending away from the lateral side of the instep opening, and wherein the upper further comprises:

a fourth strap portion that extends between and through each of the fourth pair of medial slots and the fourth pair of lateral slots, wherein the fourth strap portion is exposed at least between the fourth pair of medial slots and between the fourth pair of lateral slots, and wherein the fourth strap portion extends across the instep opening.

4. The upper for an article of footwear according to claim 1, further comprising:

a shoe lace extending through: (a) a first area defined by the first strap portion, the first pair of medial slots, and the medial side portion, (b) a second area defined by the first strap portion, the first pair of lateral slots, and the lateral side portion, (c) a third area defined by the second strap portion, the second pair of medial slots, and the medial side portion, and (d) a fourth area defined by the second strap portion, the second pair of lateral slots, and the lateral side portion.

5. An article of footwear, comprising:

a sole structure; and an upper engaged with the sole structure, the upper including:

(a) an upper member made from one or more parts and including a medial side portion that extends at least along a medial side of an instep opening of the upper member and a lateral side portion that extends at least along a lateral side of the instep opening, wherein the medial side portion includes: a first pair of medial slots spaced apart from one another in a direction extending away from the medial side of the instep opening and a second pair of medial slots spaced apart from one another in the direction extending away from the medial side of the instep opening, and wherein the lateral side portion includes: a first pair of lateral slots spaced apart from one another in a direction extending away from the lateral side of the instep opening and a second pair of lateral slots spaced apart from one another in the direction extending away from the lateral side of the instep opening;

(b) a first strap portion that extends continuously: (i) from a first medial side location on a medial side of the article of footwear where the upper engages the sole structure, (ii) between and through each of the first pair of medial slots, (iii) across the instep opening, (iv) between and through each of the first pair of lateral slots, and (v) to a first lateral side location on a lateral side of the article of footwear where the upper engages the sole structure, wherein the first strap portion is exposed at least between the first pair of medial slots and between the first pair of lateral slots, and (c) a second strap portion that extends between and through each of the second pair of medial slots and the second pair of lateral slots, wherein the second strap portion is exposed at least between the second pair of medial slots and between the second pair of lateral slots, and wherein the second strap portion extends across the instep opening.

6. The article of footwear according to claim 5, wherein the first strap portion is fixed at the first medial side location between the sole structure and a first portion of the upper, and wherein the first strap portion is fixed at the first lateral side location between the sole structure and a second portion of the upper.

7. The article of footwear according to claim 6, wherein the first portion and the second portion of the upper constitute portions of a single component part of the upper.

8. The article of footwear according to claim 5, wherein the second strap portion extends continuously from a second medial side location on the medial side of the article of footwear where the upper engages the sole structure, across the instep opening, and to a second lateral side location on the lateral side of the article of footwear where the upper engages the sole structure.

9. The article of footwear according to claim 5, wherein the first strap portion is fixed at the first medial side location between the sole structure and a first portion of the upper, wherein the first strap portion is fixed at the first lateral side location between the sole structure and a second portion of the upper, wherein the second strap portion is fixed at a second medial side location between the sole structure and a third portion of the upper, and wherein the fourth strap portion is fixed at a second lateral side location between the sole structure and a fourth portion of the upper.

10. An upper for an article of footwear, comprising:

an upper member made from one or more parts and including:

(a) a medial side portion that extends at least along a medial side of an instep opening of the upper member, (b) a lateral side portion that extends at least along a lateral side of the instep opening, (c) a first medial strap opening defined in the medial side portion;

(d) a second medial strap opening defined in the medial side portion, wherein the first medial strap opening is located closer to the lateral side portion than is the second medial strap opening;

(e) a first lateral strap opening defined in the lateral side portion; and (f) a second lateral strap opening defined in the lateral side portion, wherein the first lateral strap opening is located closer to the medial side portion than is the second lateral strap opening; and a first strap portion that extends continuously from:

(a) a first medial side location beneath an exterior surface of the medial side portion where the medial side portion of the upper member is configured to engage a sole structure, (b) through the second medial strap opening, (c) through the first medial strap opening and beneath the exterior surface of the medial side portion, wherein the first strap portion is exposed at an exterior of the medial side portion between the first and second medial strap openings, and wherein a first medial side lace engaging element is defined by the first strap portion and the medial side portion between the first and second medial strap openings, (d) across the instep area and beneath an exterior surface of the lateral side portion, (e) through the first lateral strap opening, and (f) through the second lateral strap opening to a first lateral side location beneath the exterior surface of lateral side portion where the lateral side portion of the upper member is configured to engage the sole structure, wherein the first strap portion is exposed at an exterior of the lateral side portion between the first and second lateral strap openings, and wherein a first lateral side lace engaging element is defined by the first strap portion and the lateral side portion between the first and second lateral strap openings.

11. The upper for an article of footwear according to claim 10, further comprising:

a shoe lace extending continuously through the first medial side lace engaging element, across the instep opening, and through the first lateral side lace engaging element.

12. The upper for an article of footwear according to claim 10, wherein the upper member further includes:

(a) a third medial strap opening defined in the medial side portion, (b) a fourth medial strap opening defined in the medial side portion, wherein the third medial strap opening is located closer to the lateral side portion than is the fourth medial strap opening, (c) a third lateral strap opening defined in the lateral side portion, and (d) a fourth lateral strap opening defined in the lateral side portion, wherein the third lateral strap opening is located closer to the medial side portion than is the fourth lateral strap opening;

a second strap portion that extends continuously from:

(a) a second medial side location beneath the exterior surface of the medial side portion of the upper member, (b) through the fourth medial strap opening, (c) through the third medial strap opening and beneath the exterior surface of the medial strap portion, wherein the second strap portion is exposed at the exterior of the medial side portion between the third and fourth medial strap openings, and wherein a second medial side lace engaging element is defined by the second strap portion and the medial side portion between the third and fourth medial strap openings, (d) across the instep area and beneath the exterior surface of the lateral side portion, (e) through the third lateral strap opening, and (f) through the fourth lateral strap opening to a second lateral side location beneath the exterior surface of the lateral side portion, wherein the second strap portion is exposed at an exterior of the lateral side portion between the third and fourth lateral strap openings, and wherein a second lateral side lace engaging element is defined by the second strap portion and the lateral side portion between the third and fourth lateral strap openings.

13. The upper for an article of footwear according to claim 12, further comprising:

a shoe lace extending through the first and second medial side lace engaging elements and the first and second lateral side lace engaging elements.

14. The upper for an article of footwear according to claim 12, wherein the first medial side lace engaging element is located closer to a toe area of the upper member than is the second medial side lace engaging element, and wherein the first lateral side lace engaging element is located closer to the toe area than is the second lateral side lace engaging element.

15. The upper for an article of footwear according to claim 10, further comprising:

a tongue member engaged with the upper member and extending at least partially across the instep opening of the upper member, wherein the first strap portion extends outside of an exterior surface of the tongue member.

16. The upper for an article of footwear according to claim 10, wherein the first strap portion is fixed with respect to the upper member at the first medial side location and at the first lateral side location.

17. The upper for an article of footwear according to claim 10, wherein the first strap portion is not fixed with respect to the upper member between the first medial side location and the first lateral side location moving across the instep opening of the upper member.

18. The upper for an article of footwear according to claim 10, wherein the first strap portion extends beneath a plantar support surface of the upper member from the first medial side location to the first lateral side location to thereby form a continuous loop.

19. An article of footwear, comprising:

a sole structure; and an upper engaged with the sole structure, the upper including a upper member made from one or more parts and a first strap portion, wherein the upper member includes:

(a) a medial side portion that extends at least along a medial side of an instep opening of the upper member, (b) a lateral side portion that extends at least along a lateral side of the instep opening, (c) a first medial strap opening defined in the medial side portion, (d) a second medial strap opening defined in the medial side portion, wherein the first medial strap opening is located closer to the lateral side portion than is the second medial strap opening, (e) a first lateral strap opening defined in the lateral side portion, and (f) a second lateral strap opening defined in the lateral side portion, wherein the first lateral strap opening is located closer to the medial side portion than is the second lateral strap opening, wherein the first strap member extends continuously from:

(a) a medial side location beneath an exterior surface of the medial side portion where the medial side portion of the upper member engages the sole structure, (b) through the second medial strap opening, (c) through the first medial strap opening and beneath the exterior surface of the medial side portion, wherein the first strap portion is exposed at an exterior of the medial side portion between the first and second medial strap openings, and wherein a first medial side lace engaging element is defined by the first strap portion and the medial side portion between the first and second medial strap openings, (d) across the instep area and beneath an exterior surface of the lateral side portion, (e) through the first lateral strap opening, and (f) through the second lateral strap opening to a lateral side location beneath the exterior surface of lateral side portion where the lateral side portion of the upper member engages the sole structure, wherein the first strap portion is exposed at an exterior of the lateral side portion between the first and second lateral strap openings, and wherein a first lateral side lace engaging element is defined by the first strap portion and the lateral side portion between the first and second lateral strap openings.

* * * * *